US006080255A

United States Patent [19]

Shinkai et al.

[11] Patent Number: 6,080,255

[45] **Date of Patent: *Jun. 27, 2000**

[54] METHOD OF AND AN APPARATUS FOR REMOVING IMAGE FORMING SUBSTANCE FROM AN IMAGE SUPPORTING BODY

[75] Inventors: Masaru Shinkai, Yokohama; Tarou Terashi, Sagamihara; Sotohiro Tsujihara, Kawasaki; Masatoshi Saitou, Machida; Tomoaki Sugawara, Warabi, all of Japan

[73] Assignee: Ricoh Company, Ltd., Tokyo, Japan

[ * ] Notice: This patent is subject to a terminal disclaimer.

[21] Appl. No.: 09/220,061

[22] Filed: Dec. 23, 1998

Related U.S. Application Data

[63] Continuation of application No. 08/895,278, Jul. 16, 1997, Pat. No. 5,897,726, which is a continuation of application No. 08/440,457, May 12, 1995, abandoned.

[30] Foreign Application Priority Data

May 13, 1994 [JP] Japan ..... 6-124361
Apr. 25, 1995 [JP] Japan ..... 7-124423

[51] Int. Cl.[7] ..... B08B 1/02; G03G 21/00; B05C 1/00

[52] U.S. Cl. ..... 156/94; 156/230; 156/281; 156/344; 156/359; 156/378; 156/389; 156/498; 156/584; 15/102; 15/103.5; 118/70; 118/106; 134/15; 399/71; 430/125

[58] Field of Search ..... 156/94, 230, 241, 156/247, 281, 344, 359, 378, 389, 498, 584; 15/1.51, 3, 97.1, 102, 103.5; 118/60, 70, 106; 134/15; 430/125; 101/423, 424; 399/71

[56] References Cited

U.S. PATENT DOCUMENTS 5,006,189 4/1991 Tsukamoto et al. ..... 156/247
5,463,447 10/1995 Kurotori et al. ..... 15/102 X
5,474,617 12/1995 Saito et al. ..... 134/15
5,534,063 7/1996 Maruyama et al. ..... 118/60
5,540,815 7/1996 Igarashi et al. ..... 118/106 X
5,547,793 8/1996 Kuramoto et al. .
5,605,777 2/1997 Ando et al. ..... 430/125 X
5,619,765 4/1997 Tokita et al. ..... 15/3
5,632,856 5/1997 Buie ..... 15/3 X
5,635,005 6/1997 Saitoh et al. ..... 156/230 X
5,642,550 7/1997 Maruyama et al. ..... 15/1.51
5,652,989 8/1997 Chiba et al. ..... 15/3
5,678,134 10/1997 Miki et al. ..... 399/71
5,759,278 6/1998 Tomono et al. .
5,769,957 1/1999 Murakami et al. .
5,835,837 11/1998 Saitoh et al. ..... 15/102 X
5,855,734 1/1999 Saito et al. .
5,896,612 4/1999 Maruyama et al. ..... 15/1.51
5,897,726 4/1999 Shinkai et al. ..... 156/94

*Primary Examiner*—Curtis Mayes
*Attorney, Agent, or Firm*—Oblon, Spivak, McClelland, Maier & Neustadt, P.C.

[57] ABSTRACT

In a toner removing apparatus in which, after toner attached to transferring paper is heated and adheres to a peeling-off belt, transferring paper is separated from the belt and thereby toner is peeled off from transferring paper, the peeling-off belt is cooled by a cooling fan and thereafter toner is removed therefrom. The transferring paper is tightly attached to the peeling-off belt, and a cleaning fan is provided so as to oppose to the peeling-off belt passing through the pressurizing portions of upper and lower heating rollers for heating the belt and moving to the cleaning portion in the belt cleaning apparatus. The temperature of toner is lowered in order to harden toner to an extent that the condensation of the image forming substance sticking on the peeling-off belt turns out to be larger than the sticking force between the image forming substance and the peeling-off belt member.

53 Claims, 13 Drawing Sheets

| PROPERTIES OF TONER / TONER SAMPLES | AVERAGE VOLUME PARTICLE DIAMETER | SOFTENING TEMPERATURE | FLOW STARTING TEMPERATURE |
|---|---|---|---|
| TONER SAMPLE 1 POLARITY (+) | 11.5 μm | 85 °C | 128 °C |
| TONER SAMPLE 2 POLARITY (+) | 9.0 μm | 76 °C | 110 °C |
| TONER SAMPLE 3 POLARITY (-) | 9.0 μm | 80 °C | 117 °C |
| TONER SAMPLE 4 POLARITY (-) | 7.5 μm | 76 °C | 106 °C |

*FIG. 7*

PROCESSES FOR FIXING (LOWER PART) TONER AND REMOVING (UPPER PART) TONER

METHOD OF AND AN APPARATUS FOR REMOVING IMAGE FORMING SUBSTANCE FROM AN IMAGE SUPPORTING BODY

This application is a continuation of application of application Ser. No. 08/895,278, filed on Jul. 16, 1997, now U.S. Pat. No. 5,897,726, which is a continuation of Ser. No. 08/440,457, filed on May 12, 1995, now abandoned.

BACKGROUND OF THE INVENTION

1. Field of the Invention

The present invention relates to a method of and an apparatus for removing image forming substance from an image supporting body to which image forming substance is stably attached by means of an image forming apparatus such as copying machine, facsimile device, printer, press printing machine, etc. In particular, the method of and the apparatus for removing image forming substance from the image supporting body comprises peeling-off means in which a peeling-off member capable of exerting stronger sticking force than that between the surface of the image supporting body and the image forming substance on the image forming substance sticking to the surface of the image supporting body is brought into contact with the image forming substance on the surface of the image supporting body. After the image forming substance is heated and adhered to the peeling-off member the image supporting body and the peeling-off member are separated from each other, and thereby the image forming substance is peeled off and removed from the surface of the image supporting body.

2. Description of the Background

Conventionally, regarding the removal apparatus for removing the image forming substance such as toner from the copying paper as the recorded image supporting body, for instance, Japanese Laid-open Patent Publication No. 2-55195/1990 discloses an image forming substance removing apparatus for removing thermally-fusable ink or toner mounted by use of the electrophotographic or thermally transferring method on a printing body constructed with a supporting body painted with peeling-off agent. The ink or toner sticks to the ink peeling-off member and is thereby removed from the printing body. The ink peeling-off member is superposed on the printing body and the superposed elements pass through between the heating roller and the pressurizing roller, and after being cooled, the ink peeling-off member is peeled off.

Furthermore, Japanese Laid-open Patent Publication No. 4-64472/1992 discloses an eraser comprising an endless sheet having at least thermally-fusable resin on the surface thereof, a heating roller and a cooling roller for supporting and rotating the endless sheet, a pressing roller for pressing the paper (erasable paper) processed with peeling-off treatment on the surface thereof to the softened or fused thermally-fusable resin, and a driving portion for driving those elements in interlocking relationship therebetween.

Furthermore, Japanese Laid-open Patent Publication No. 4-82983/1992 discloses an image forming substance removing apparatus comprising two (a pair of) rollers rotating in a state of being brought into pressurized contact with each other and causing paper to pass through the pressurizedly contacting portion, a heater for heating at least one of the above-mentioned two rollers, and a scratching unit for separating the paper passing through the pressurizedly contacting portion from the rollers.

And further, according to the present applicants' proposals of the image forming substance removing method, the recorded image supporting body supports at least one sort of water or water solution which is selected from the group consisting of water as an unstable agent, water solution including a surface active agent, water solution including water-soluble polymer, and water solution including surface active agent and water-soluble polymer. A peeling-off member is interposed and thereby the image forming substance is thermally or pressurizedly adhered to the peeling-off member so that the image forming substance is peeled off from the image supporting body. (For instance, refer to Japanese Patent Application No. 4-255916/1992.) According to this proposal, only the image forming substance can be removed without damaging the paper quality of the image supporting body comparatively.

SUMMARY OF THE INVENTION

In the removing apparatus for removing the image forming substance from the image supporting body, since the image forming substance is transferred from the image supporting body to the peeling-off member, etc., in case that the peeling-off member or the like is repeatedly employed, the image forming substance is piled up gradually on the surface of the peeling-off member or the like. In order to prevent the image forming substance from piling up, the apparatus may provide cleaning of the image forming substance on the roller on which the image forming substance is transferred.

Hereupon, according to the experiment performed by the present inventors, in order to preferably remove the image forming substance from the peeling-off member such as the rollers on which the image forming substance is transferred, it is necessary to satisfy a constant condition. The inventors could find out various troublesome matters such as incomplete removal of the image forming substance when the constant condition has not been satisfied. For instance, in the removing apparatus for removing the image forming substance from the image supporting body proposed in the afore-mentioned Japanese Patent Application No. 4-255916, in the case of employing a brush roller having a core member planted with a large number of fibers made of brass or resin, the image forming substance was not removed completely and remains on the peeling-off member as if the image forming substance is extended by the brush with the tail-like trailing portion. When the image forming substance remains on the surface of the peeling-off member in such manner, the image supporting body is jammed in the apparatus due to the unfavorable separation of the image forming substance from the image supporting body, at the time of removing the image forming substance by contacting with and separating from the image supporting body.

The present invention has been made in consideration of the above-mentioned actual circumstances and troublesome matters to be solved.

It is an object of the present invention to solve the points at issue as mentioned heretofore.

It is another object of the present invention to provide a method of and an apparatus for removing image forming substance from an image supporting body.

It is still another object of the present invention to provide an apparatus for removing image forming substance from an image supporting body in which a peeling-off member can be brought into contact with the image forming substance on the surface of the image supporting body. After heating the image forming substance and binding that to the peeling-off member with adhesive agent the image supporting body and the peeling-off member can be separated from each other, and further the image forming substrate can be peeled off and removed from the surface of the image supporting body.

It is still another object of the present invention to provide the apparatus for removing image forming substance in which the image forming substance can be preferably removed from the surface of the peeling-off member, and further the surface of the peeling-off member can be kept in a preferable state of demonstrating a function of removing the image forming substance therefrom.

It is still another object of the present invention to provide the apparatus for removing image forming substance in which jamming of the image supporting body occurring in the apparatus due to unfavorable separation between the peeling-off member and the image supporting body.

It is still another object of the present invention to provide the apparatus for removing image forming substance in which peeling-off of the paper fiber is performed in the case of employing paper as the image supporting body.

It is still another object of the present invention to provide the apparatus for removing image forming substance in which the selection width of the toner removal processing speed can be widened aiming at realizing highspeed processing without making the apparatus large-sized.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 7 is a table showing the properties of toner;

DESCRIPTION OF COPIED PAPER RECYCLING MACHINE CAPABLE OF REMOVING TONER ON THE PAPER

A copier more friendly to the society for recycling copied paper (Copied Paper Recycling Machine) is explained hereinafter, referring to FIG. 8 and FIG. 9.

Figure 8:
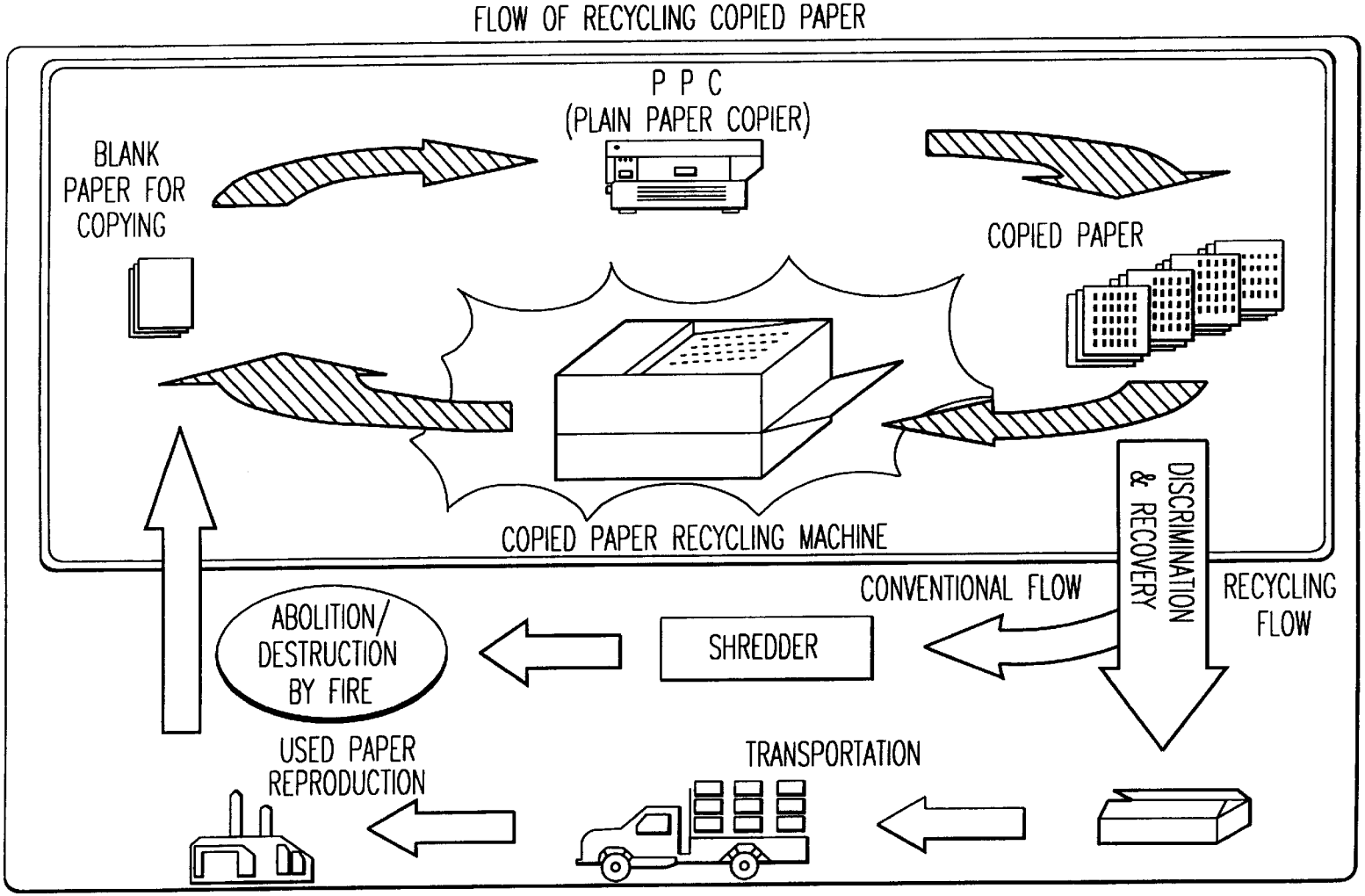
FIG. 8 is a diagram illustrating the recycling flow for copied paper.

FIG. 8 shows a flow of recycling the copied paper. FIG. 9 shows a flow of the recycling process according to the present invention in comparison with that of the toner fixing process.

Wherever office you may go, you see a pile of paper at first in every quarter of the office. While the concept of a "paperless office" has been in vogue for some time, the reality is that modern offices are anything but paperless. In practice, the amount of paper Consumption has been sharply increased together with the advancement of electronics. Even in the case of obtaining the electronic information, there remains the necessity of a hard copy employing papers. Consequently, when the recycling of the papers is discussed in the office, there arises a big problem of paper consumption. At present, the amount of paper used in offices in Japan is thought to be 1,500,000 tons per year. One third of the total amounts (that is, 500,000 tons of paper) is copied paper which is copied by utilizing the electrophotographic system or technology. The rate of utilizing such system or technology has been largely increased in accordance with the increase in number of the electrophotographic type facsimile device and printer. For instance, in Tokyo, Marunouchi District, more than half of the office waste is "paper".

FIG. 8 shows a recycling loop of paper in the office. Conventionally, the discrimination and abolishment of paper have been carried out. The paper is discriminated among corrugated cardboard, newspaper, magazine, PPC copying paper. The degree of recycling the paper has been processed in this order. However, it is difficult to peel off the toner from the paper because of strong adhesive force between the toner and the paper. The discrimination is done not for the PPC copying paper itself, but for facilitating the recycling operation for the other type copying paper. In a present situation in which the cost of pulp is lowered as in the case of recent years, the PPC copying paper is solely abolished or burned, practically.

Another fatal factor of making difficult the recycling of paper in the office is the protection for the confidential matters. For this purpose, a shredder is used very often. The bulky waste remains at the time of abolishing (shredding) the paper and transporting the waste is difficult. In addition, since the paper fiber is cut (torn) into pieces, it is impossible to recycle into good-quality paper.

The present technology developed this time enables to peel off and remove only the toner from the PPC copying paper. Consequently, the blank paper with the toner removed therefrom can be employed for the next copying as it is. The employment cycle can be realized up to about ten times in the laboratory. Even assuming that the cycle is only one time, the amount of using the virgin (raw) pulp is largely reduced, for instance, one half, and further this matter is effective (advantageous) for the environment.

In FIG. 8, the area encircled with a wide rectangular frame represents the flow of recycling copied paper by use of the newly developed copied paper recycling machine. The area outside of the wide rectangular frame represents the conventional flows of recycling copied paper in two ways; those are, (1) waste copied paper is shredded by the shredder, and thereafter is abolished or destroyed by fire, and (2) waste copied paper is recovered and discriminated, transported by truck to the reproducing factory, and reproduced into blank copying paper.

Figure 9:
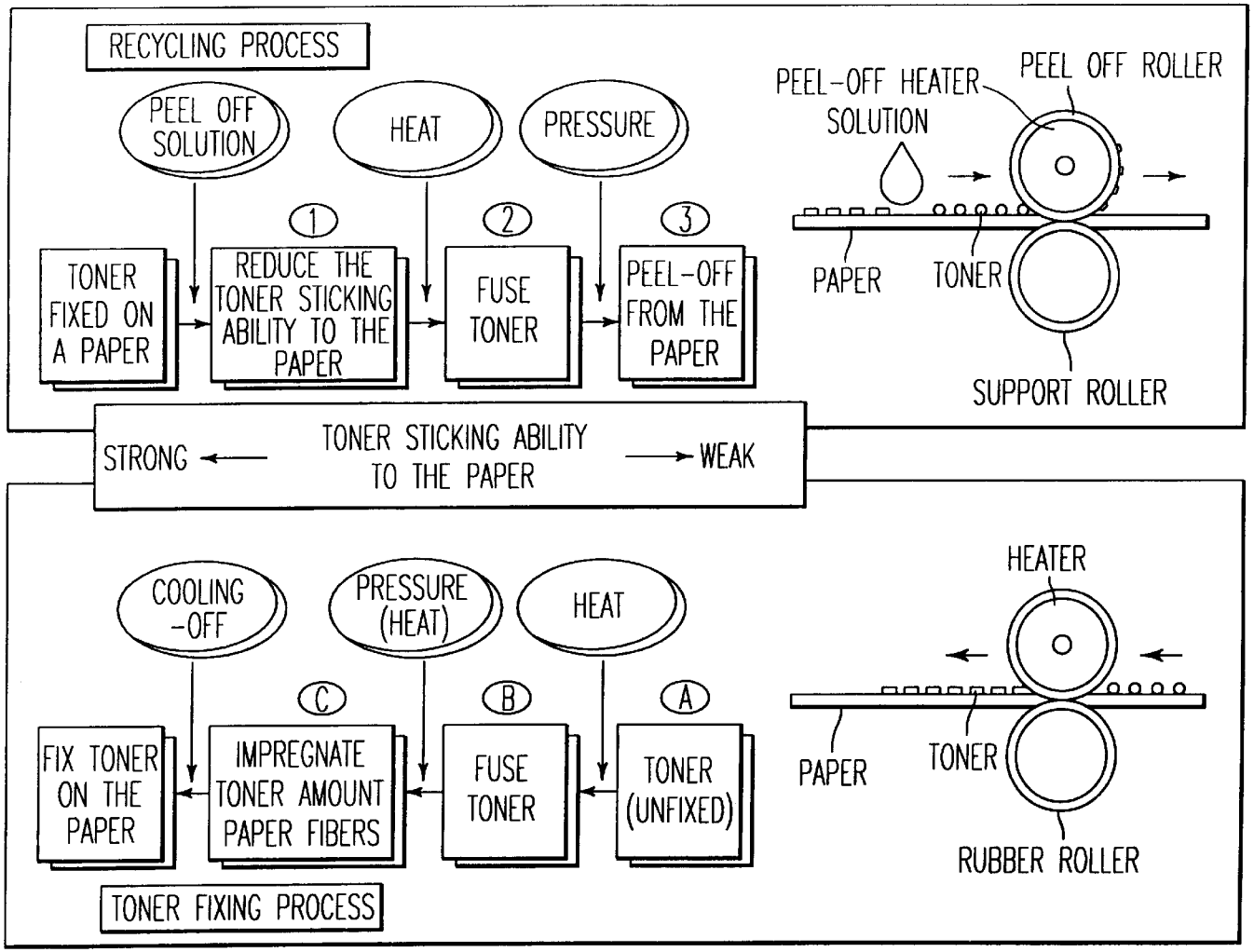
FIG. 9 is another diagram illustrating a flow of the recycling process in a recycling machine and that of the toner fixing process in a copying machine.

FIG. 9 shows a flow of recycling process according to the present invention, in more detail, in (comparison with that of the toner fixing process. The former is the inverse process to that of the latter.

Proliferation of plain paper copiers, printers and facsimiles is a symbol of advanced office automation. A huge consumption of paper in these equipments, however, has caused a keen social concern. It has been necessary to respond to this social issue by developing technologies for recycling copied paper.

Ubiquitous use of plain paper copiers (PPC) has been a symbol of office automation. The PPC technology has been adapted to laser beam printers and plain paper facsimiles to generate readable office documents. The advent of full color copiers has made possible faithful reproduction even of color images. These are good news items. There is bad news, however. Proliferation of PPC equipments generates a huge amount of paper, most of which has to be discarded after use. The annual paper consumption in Japanese offices alone has reached 1.5 million metric tons, about one third of which involves PPC paper. Hence, recycling of copied paper has become a keen social issue in urban waste management and environmental preservation of forests.

Most PPC equipments use toner, namely, a black powder containing thermosensitive resin, to form images on paper. The toner is first deposited by electrostatic force onto the surface of a blank paper sheet and is then firmly fixed onto the sheet by the application of heat and pressure. This melts the toner, which impregnates into spaces between paper fibers and then solidifies. The adhesion between toner and fibers is so strong that the conventional deinking process in a paper recycle plant cannot completely remove toner from fibers. This makes recycling copied paper rather difficult. Another difficulty in recycling copied paper is due to the abundant use of a shredder for security of information on office documents. A shredder cuts paper fibers into very short pieces which can be reused only in making poor quality paper.

As a leading manufacturer of PPC equipments, research on recycling copied paper has been active. The first part of this information described here presents a new technology for removing toner from a paper sheet, which can be used as a blank sheet for new copying.

The lower part of FIG. 9 shows the process for fixing toner on the surface of a paper, as described above. The new technology works almost in the opposite way to this fixing process as shown in the upper part of FIG. 9.

First, a small amount of peel-off solution is applied to the surface of a copied paper (1). The solution reduces the adhesion strength between toner and paper fibers. Next, heat is applied to fuse the toner (2), and then pressure is applied to transfer molten toner onto the surface of a peel-off roller (3). Toner thus transferred onto the peel-off roller can be scraped off and discarded. The quantity of discarded toner is small and can be handled in the conventional waste toner disposal system of PPC equipments. The peel-off solution is water-based, safe and pollution-free. Hence, there is little stress on the environment due to this recycling process. The paper thus recycled can be used again for new copying. These fixing and recycling processes can be repeated many times. A paper has been reused as many as ten times in a laboratory. In practice, however, accumulated wear and contamination will set a limit. Even one recycle will reduce the consumption of paper and hence forest resources to one half. Office waste also will be halved. The use of a shredder can be limited to only very sensitive documents. There are little differences in characteristics of the toner and the fixing process described in FIG. 9 among manufacturers. Hence, the same recycling process can be applied to most papers copied by machines of different make.

Next, a prototype machine is described. Copied paper sheets in the lower tray comes out as blank sheets in the upper tray. The size of the machine is 82×63×40 cm. The operating speed is 3 sheets per minute. There is much room for improvement in performance. In fact, the second generation prototype, demonstrated in Business Show in Tokyo, runs at a speed of 5 sheets per minute.

A conventional recycle loop for paper is extended to the outside of an office. It includes the collection and transportation of waste and the treatment at a recycle plant. Most of its cost is borne by a local government. There are also such hidden costs to the society as traffic jams and air pollution due to truck exhaust emission. The present technology can shorten the recycle loop to one within an office and eliminate these social costs.

It is planned to introduce a commercial model before long. It should be noted, however, that the cooperation of users is essential for practical acceptance of the technology. For example, copied paper sheets have to be placed on one-sided and neatly stacked. Staples have to be removed. Paper sheets with marks by pencil or pen have to be rejected at the disposal. There are technologies available for detecting double-sided sheets or mark up or presence of a staple. However, the use of these technologies will make a machine very expensive.

DETAILED DESCRIPTION OF THE PREFERRED EMBODIMENTS

In order to attain the objects mentioned before, the first embodiment according to the present invention proposes the method of removing image forming substance from the image supporting body comprising peeling-off means in which a peeling-off member capable of exerting stronger sticking force than that between the surface of the image supporting body and the image forming substance on the image forming substance sticking to the surface of the image supporting body is brought into contact with the image forming substance on the surface of the image supporting body. After the image forming substance is heated and adhered to the peeling-off member the image supporting body and the peeling-off member are separated from each other, and thereby the image forming substance is peeled off and removed from the surface of the image supporting body.

The first embodiment is featured in that, after the temperature is lowered to an extent that the condensation (cohesion) force turns out to be larger than the sticking force between the image forming substance and the peeling-off member, the image forming substance sticking to the peeling-off member is removed by the cleaning member brought into contact with the surface of the peeling-off member.

In order to attain the objects mentioned before, the second embodiment according to the present invention proposes the apparatus for removing image forming substance from the image supporting body comprising peeling-off means in which a peeling-off member capable of exerting stronger sticking force than that between the surface of the image supporting body and the image forming substance on the image forming substance sticking to the surface of the image supporting body is brought into contact with the image forming substance on the surface of the image supporting body. After the image forming substance is heated and adhered to the peeling-off member the image supporting body and the peeling-off member are separated from each other, and thereby the image forming substance is peeled off and removed from the surface of the image supporting body.

The second embodiment is featured in that the cleaning member for cleaning the surface of the peeling-off member and thereby removing the image forming substance from the peeling-off member is provided so as to come into contact with the surface of the peeling-off member at the location where the temperature is lowered to an extent that the condensation (cohesion) force turns out to be larger than the sticking force between the image forming substance and the peeling-off member.

In order to attain the objects mentioned before, the third embodiment according to the present invention proposes the apparatus for removing image forming substance from the image supporting body comprising peeling-off means in which a peeling-off member capable of exerting stronger sticking force than that between the surface of the image supporting body and the image forming substance on the image forming substance sticking to the surface of the image supporting body is brought into contact with the image forming substance on the surface of the image supporting body. After the image forming substance is heated and adhered to the peeling-off member the image supporting body and the peeling-off member are separated from each other, and thereby the image forming substance is peeled off and removed from the surface of the image supporting body.

The apparatus further comprises: a cleaning member for cleaning the surface of the peeling-off member and thereby removing the image forming substance from the peeling-off member, and a cooling apparatus for cooling the image forming substance on the peeling-off member to be transported to the contact portion to be contacted with the peeling-off member surface cleaning member after separating the image forming substance from the above-mentioned image supporting body.

In order to attain the objects mentioned before, the fourth embodiment according to the present invention proposes the apparatus featured in that, in the third embodiment, there is further provided control means for controlling the operation of the above-mentioned cooling apparatus on the basis of temperature detecting means for detecting the temperature of the peeling-off member and the temperature detected by the above temperature detecting means. Hereupon, it is desirable to provide the temperature detecting means such that the temperature of the peeling-off member portion is detected immediately before the peeling-off member is brought into contact with the peeling-off member surface cleaning member.

In the first through fourth embodiments according to the present invention, the peeling-off member in the peeling-off means is brought into contact with the image forming substance on the image supporting body's surface. After heating the image forming substance and bonding that to the peeling-off member the image supporting body and the peeling-off member are separated from each other, and thereby the image forming substance is peeled off and removed from the surface of the image supporting body.

At the time point when the temperature is lowered to an extent that the condensation force of the image forming substance on the peeling-off member for removing the image forming substance from the peeling member turns out to be larger than the sticking force between the image forming substance and the peeling-off member, the peeling-off member surface cleaning member is brought into contact with the surface of the peeling-off member, and thereby the image forming substance is removed from the surface of the peeling-off member.

In the third embodiment, the image forming substance on the peeling-off member transported to the contact portion with the peeling-off member surface cleaning member after being separated from the image supporting body is cooled by the cooling apparatus. In such construction, even though the distance between the separating position from the image supporting body and the peeling-off member surface cleaning member is comparatively short, the apparatus is constructed such that the temperature of the image forming substance on the peeling-off member can be lowered to a desired temperature.

In the fourth embodiment, the operation of the above-mentioned cooling apparatus can be controlled on the basis of the temperature of the afore-mentioned peeling-off member detected by the temperature detecting means. Thereby, the temperature of the image forming substance on the peeling-off member at the time point when the image forming substance on the peeling-off member arrives at the contact portion with the peeling-off member surface cleaning member can be surely lowered to a desired temperature regardless of the variation of the temperature in the apparatus.

Embodiments

Hereinafter is described an embodiment according to the present invention applied to an image forming substance removing apparatus (hereinafter, called "toner removing apparatus") for removing the hydrophobic and thermoplastic (thermally fusable) toner, employed in the electrophotographic copying machine (hereinafter, called "toner") as an image forming substance, from the transferring paper employed as the image supporting body on which the image is formed by use of the transferring-type electrophotographic copying machine.

At first, the outline of one example (embodiment) of a toner removing apparatus which can be applied to the present invention is explained hereinafter.

Figure 1:
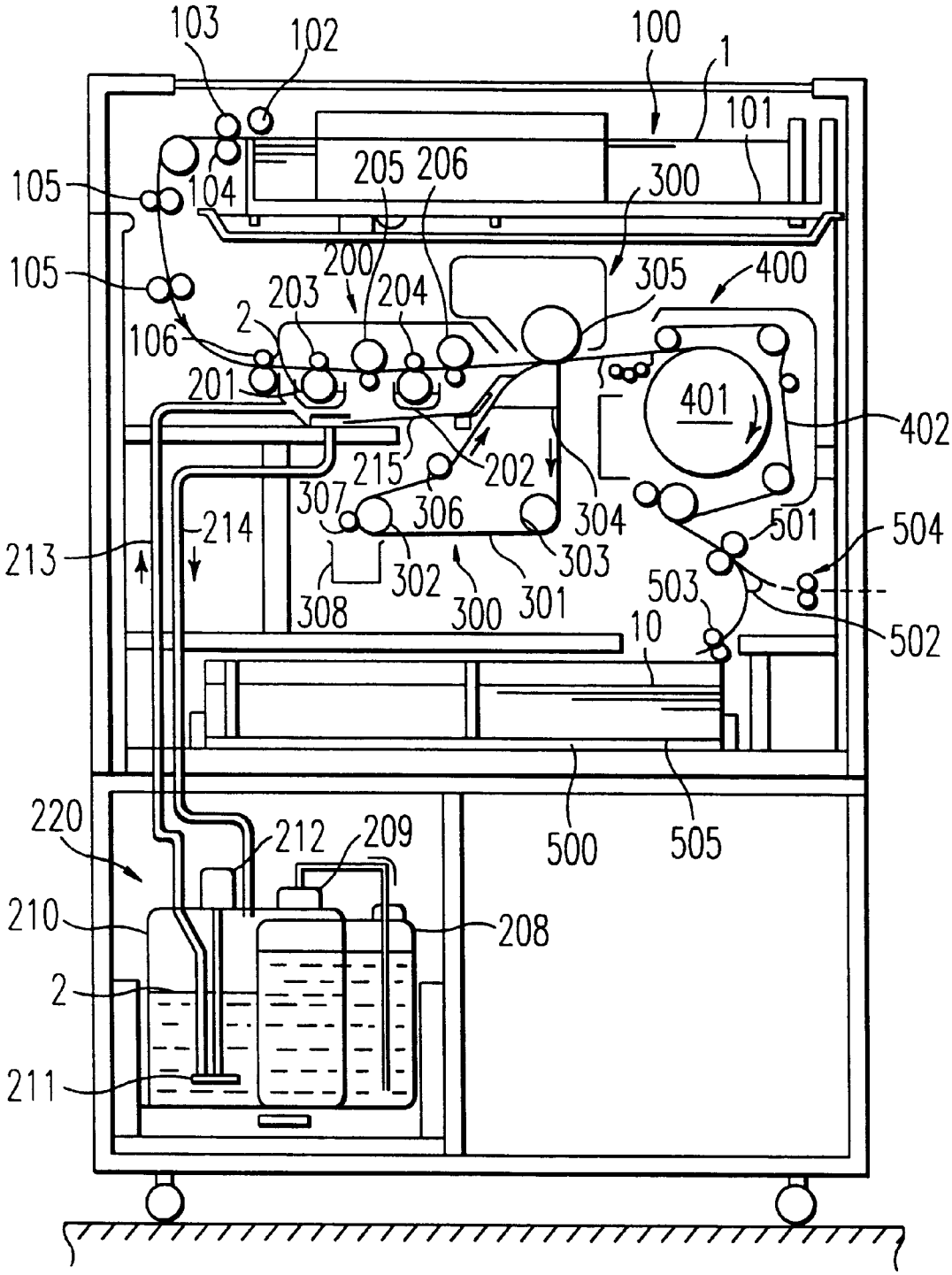
FIG. 1 is a front view showing an outlined construction of a toner removing apparatus according to the present invention.

FIG. 1 is a front view showing an outline construction of a toner removing apparatus according to the present invention. In the above-mentioned apparatus, a thermally-fusable toner (hereinafter, called "toner") is removed from the transferring paper employed as an image supporting body having an image formed thereon by use of a transferring type electrophotographic copying machine.

In FIG. 1, the toner removing apparatus comprises a paper feeding unit 100 for separatingly feeding one by one the transferring paper 1 having toner formed thereon from a pile of papers 1, a liquid applying unit 200 employed as a destabilizing liquid applying means for applying a destabilizing liquid to the transferring paper 1 transported from the paper feeding unit 100, a liquid supplying apparatus 207 for supplying a below-mentioned processing liquid 2 to the liquid applying unit 200, a toner peeling-off unit 300 employed as peeling-off means for peeling off and removing the toner from the transferring paper 1 to which the destabilizing liquid is supplied, a dryer unit 400 for drying the transferring paper 1 from which the toner removed, and a paper receiving unit 500 for receiving the transferring paper 1 discharged from the dryer unit 400.

The above-mentioned paper feeding unit 100 feeds in order the transferring paper 1 piled on a bottom plate 101 from the upper-most paper by use of a paper feeding roller 102. In such construction, duplicate papers sticking to each other are separated by a separating mechanism constructed with a feed roller 103 and a separate roller 104 and thereby only one sheet of transferring paper 1 is sent out. The transferring paper 1 sent out by the paper feeding unit 100 is transported by a couple of transporting rollers 105. A couple of register rollers 106 perform the timing adjustment and the skew compensation for the transported paper, and the paper is transported to the next liquid applying unit 200. Hereupon, since the concrete construction and performance of the above-mentioned paper feeding unit 100, etc. is same as that of the paper feeding mechanism in the ordinary electrophotographic copying machine, the detailed description thereof is omitted here.

The afore-mentioned liquid applying unit 200 comprises a liquid container filled with a predetermined quantity of the processing liquid 2 employed as a destabilizing liquid for making unstable the sticking state between the transferring paper 1 and the toner. There are further provided, in the direction of transporting the transferring paper, two stages of liquid painting (applying) units 201 and 202 respectively (Constructed with a liquid painting (applying) roller put in the liquid contained in the liquid container so as to partially sink therein. On the upper portion of the liquid painting (applying) roller of the respective liquid painting (applying) units, there are provided paper restricting rollers 203 and 204 at a predetermined interval such that the surface of the liquid painting (applying) rollers respectively oppose the paper restricting rollers. And further, in the direction of transporting the transferring paper 1, there are provided a pair of relaying rollers 205 and another pair of relaying rollers 206 for respectively transporting the transferring paper between the first-stage liquid painting (applying) unit 201 and the second-stage liquid painting (applying) unit 202 and at the downstream of the second-stage liquid painting (applying) unit.

Furthermore, a liquid receiving tank 215 is provided at the lower side of the respective liquid painting units 201 and 202 and the pair of relaying rollers 205 and 206.

As to the above-mentioned processing liquid 2, it is possible to use at least one sort of water or water solution selected from the group consisting of water, water solution including a water-soluble polymer, water solution including a surface active agent, and water solution including a water-soluble polymer and surface active agent.

The above-mentioned liquid supplying apparatus 207 is provided at the lower part of the apparatus and the same is constructed with an interchangeable supplementary liquid bottle 208, a processing liquid tank 210 adequately supplemented with the processing liquid 2 by an electromagnetic pump 209 from the supplementary liquid bottle 208, a liquid supplying pump 211 such as shuttle pump, etc. which is accommodated in the processing liquid tank 210, a pump motor 212 for rotatively driving the liquid supplying pump 211, a liquid supplying pipe 213 for sending out the processing liquid 2 from the liquid supplying pump 211 to liquid containers 201 and 202, and a recovering pipe 214 for recovering the processing liquid 2 discharged to a liquid receiving tank 215 from a liquid discharging outlet provided at the lower part of liquid containers 201*a* and 202*a* to the processing liquid tank 210, etc.

Hereupon, the processing liquid 2 sent by the liquid supplying pump 211 passes through the liquid supplying pipe 213 and the same is supplied to the liquid containers of liquid painting units 201 and 202. And then, the processing liquid 2 flowing out from the liquid container and received by the liquid receiving tank 215 passes through the recovering pipe 214 and is recovered into the processing liquid tank 210. In such manner, the processing liquid 2 circulates in the same route. During the time period of such usual circulating operation of the processing liquid 2, in the respective liquid painting units 201 and 202, the quantity of supplying liquid by use of the liquid supplying pump 211 is set such that the liquid painting roller is partially submerged by a predetermined amount in the processing liquid 2 contained in the liquid container.

The above-mentioned toner peeling-off unit 300 comprises a toner offset belt 301 employed as a belt-shaped peeling-off member hung over a plurality of supporting rollers 302 and 303 (hereinafter, called "offset belt"), a heating block 304 and an upper heating roller 305 both provided so as to put the offset belt 301 therebetween and come into pressurized contact with each other and respectively containing a heating lamp therein, a tension roller 306 for applying predetermined tension to the offset belt 301, a cleaning brush 307, for instance, made of metal for removing the toner in a state of coming into contact with the surface of the offset belt 301 and rotating therearound, and a toner receiver 308 for receiving the toner removed by use of the cleaning brush 307. Moreover, it is necessary to frequently exchange the offset belt 301 in the toner peeling-off unit 300 due to deterioration by using it. The exchanging works on this occasion are described later.

Hereupon, the afore-mentioned heating block 304 and the upper heating roller 305 cause the toner image surface of the transferring paper 1 to adhere closely to the offset belt 301. And further, for the softened toner, at least the surface at the side of the above offset belt brought into contact with the toner is made of the material which can demonstrate a sticking force larger than that between the surface of the transferring paper 1 and the toner. For instance, the belt itself is made of metal material such as aluminum alloy, copper alloy, nickel alloy, etc. or high molecular (polymer) material such as polyethylene terephthalate (PET) dispersed with titan oxide. And further, the offset belt 16 is constructed with plural layers. At least one layer among those plural layers is made of a heat-proof layer having superior strength and heat-resisting property. And further, it is permitted that the layer brought into contact with the toner is made of an adhesive layer having a superior sticking property with the toner.

Furthermore, at the downstream side in the moving direction of the offset belt 301 from the pressurized contact portion between the heating block 304 and the heating roller 305, a curvature portion is formed so as to change the moving direction of the offset belt 301 by almost 900, with a predetermined curvature radius. The moving direction of the belt is sharply changed around the curvature portion, and thereby a curvature separation of the transferring paper 1 is performed from the offset belt 301.

The above-mentioned drying unit 400 dries the transferring paper 1 such that the liquid supporting quantity of the transferring paper 1 turns out to be not more than 10% of the total paper weight, and the same 400 is constructed with a heating drum 401 made of, for instance, aluminum and containing the heating lamp therein and a paper pressing belt 402 suspended around plural supporting rollers and endlessly moving in a state of winding on the circumferential surface of the heating drum 401 by a constant angle.

As the material of the afore-mentioned paper pressing belt 402, it is possible to employ heat-proof and ventilatative substance, that is, cloth such as canvas cloth, cotton cloth, tetron cloth, etc.

The above-mentioned paper receiving unit 500 is constructed with a couple of transporting rollers 501 for transporting the transferring paper 1 from the drying unit, a separation claw 502, a couple of discharging rollers 503 and 504, an accommodated paper discharging tray 505, an external paper discharging tray not shown In FIG. 1, etc., and as occasion demands it is possible to select the paper discharging onto the accommodated paper discharging tray 505 or the external paper discharging tray. Hereupon, the above-mentioned accommodated paper discharging tray 505 is slidably constructed so as to draw out to the front side of the apparatus.

In the toner removing apparatus thus constructed, the toner image surface (in FIG. 1, the lower surface) of the transferring paper 1 transported from the paper feeding unit 100 is applied with the processing liquid 2 at the liquid applying unit 200 and sent to the toner peeling-off unit 300. For instance, in the case of employing the A4-size transferring paper 1, the processing liquid of not less than 2 g is applied thereto. In the toner peeling-off unit 300, the toner firmly sticking to the transferring paper 1 is softened by the heating operation of the heating block 304 and the upper heating roller 305 and sticks to the surface of the offset belt 301. And then, when the transferring paper 1 is separated from the offset belt 301 around the curvature portion of the treating block 304, the toner sticking to the surface of the offset belt 301 is peeled off from the transferring paper 1 and thereby the toner is removed from the transferring paper 1. The transferring paper 1 from which the toner is removed is dried by the drying unit 400, and the paper 1 is discharged onto the accommodated paper discharging tray 505 of the paper receiving unit 500 by the action of the pair of the paper discharging roller 503.

In such situation of the toner removal processing as mentioned heretofore, since the toner is peeled off in a state in which the liquid is supplied to the transferring paper 1 and the supplied liquid infiltrates into the boundary portion between the transferring paper 1 and the toner, the toner can be removed without injuring (damaging) the paper fiber.

In FIG. 2, the toner removing apparatus for removing toner from the copied sheet relating to the embodiment comprises a paper feeding unit 820 for separating and feeding one by one paper 810 having toner image formed thereon from a pile of papers, a liquid supplying unit 830 for supplying liquid to the paper 810 transported from the paper feeding unit, a toner removing unit 840 for removing toner from the paper 810 supplied with liquid, a drying unit 860 for drying the paper 810 removed toner therefrom, and a paper receiving unit 900 for receiving the paper 810 discharged from the drying unit. 860.

The above-mentioned paper feeding unit sends out the transferring paper 810 one by one to the liquid supplying unit 830. One surface of the transferring paper on which the toner image is formed (hereinafter, called "toner image surface") faces the lower side. For instance, the above paper feeding unit is the same one as that of the electrophotographic copying machine.

The above-mentioned liquid supplying unit 830 is the one which supplies the liquid 831, such as water solution containing a surface active agent, to the paper 810 in order to improve permeability to the water of the paper 810. The liquid supplying unit 830 comprises a liquid container 832 for accommodating liquid therein, an applying roller 833 installed so as to partially submerge in the liquid contained in the liquid container 832 for drawing up (pumping up) the liquid by the action of rotation thereof and supplying the liquid to the toner image surface of the paper 810, and d restricting roller 834 as paper restricting member which is installed so as to put the paper transporting route (path) therebetween and oppose to the applying roller 833. Regarding the applying roller 833, it is possible to employ a material having liquid-keeping property such as a hydrophilic (water-acceptable) porous material, a roller constructed with sponge, etc., and a roller made of an elastic body consisting of rubber, etc. or rigid body such as metal.

The afore-mentioned toner removing unit 840 comprises a peeling-off belt 844 as a sheet-shaped peeling-off member which is suspended around plural supporting rollers 841, 842 and 843, a pair of upper and lower heating rollers 845 and 846 respectively including heating lamps 845*a* and 845*b* which are installed so as to put the peeling-off belt 844 therebetween and come into pressurized contact with each other and a belt cleaning apparatus 847 for removing the toner from the surface of the peeling-off belt 844.

At least the surface of the peeling-off belt 844 is made of a material on which the softened toner can easily stick. For instance, the belt itself is made of metal material such as aluminum (alloy), copper (alloy), nickel (alloy), etc., or high molecular (polymer) material such as polyethylene terephthalate (PET) including dispersed oxidized titanium. In the case of employing the high molecular (polymer) material as the surface material, it is desirable to use multi-layer structure of at least two layers between base and surface layer from the viewpoint of preventing the expansion due to tension and/or heat.

Among the supporting rollers of the peeling-off belt 844, the roller 843 on which the belt portion wind around after passing through the pressurized portion of the upper and lower heating rollers 845 and 846 has a small diameter. The moving direction of the belt is sharply changed around that position. Thereby, a curvature separation of the paper 810 can be performed from the peeling-off belt 844. There are further provided a tension roller 849 for thrusting inside the belt portion between the supporting roller 841 opposing to the belt cleaning unit and the lower heating roller 846.

And further, the upper and lower heating rollers 845 and 846 bring the toner image surface on the paper 810 into tight contact with the peeling-off belt 844, and the same heat and soften the toner firmly sticking to the paper 810.

As to such heating, it is desirable to heat the toner on the pressurized portion between the upper heating roller 845 and the peeling-off belt 844 to an extent that the toner on the paper is not fused.

And further, the afore-mentioned belt cleaning apparatus 847 comprises a rotatable brush roller 850 for removing the attached toner by exerting an intermittently-scratching force on the circumferential surface of the peeling-off belt 844, and a toner removing blade 851 consisting of metal or resin which is brought into pressurized contact with the surface of the peeling-off belt 844 at the down-stream side in the belt moving direction from the rotatable brush roller 850. In such construction, the toner removed from the circumferential surface of the belt is accommodated in a unit casing 852. The condition of preferably removing the toner from the peeling-off belt 844 by means of the belt cleaning apparatus 847 is described below in more detail.

Figure 2A:
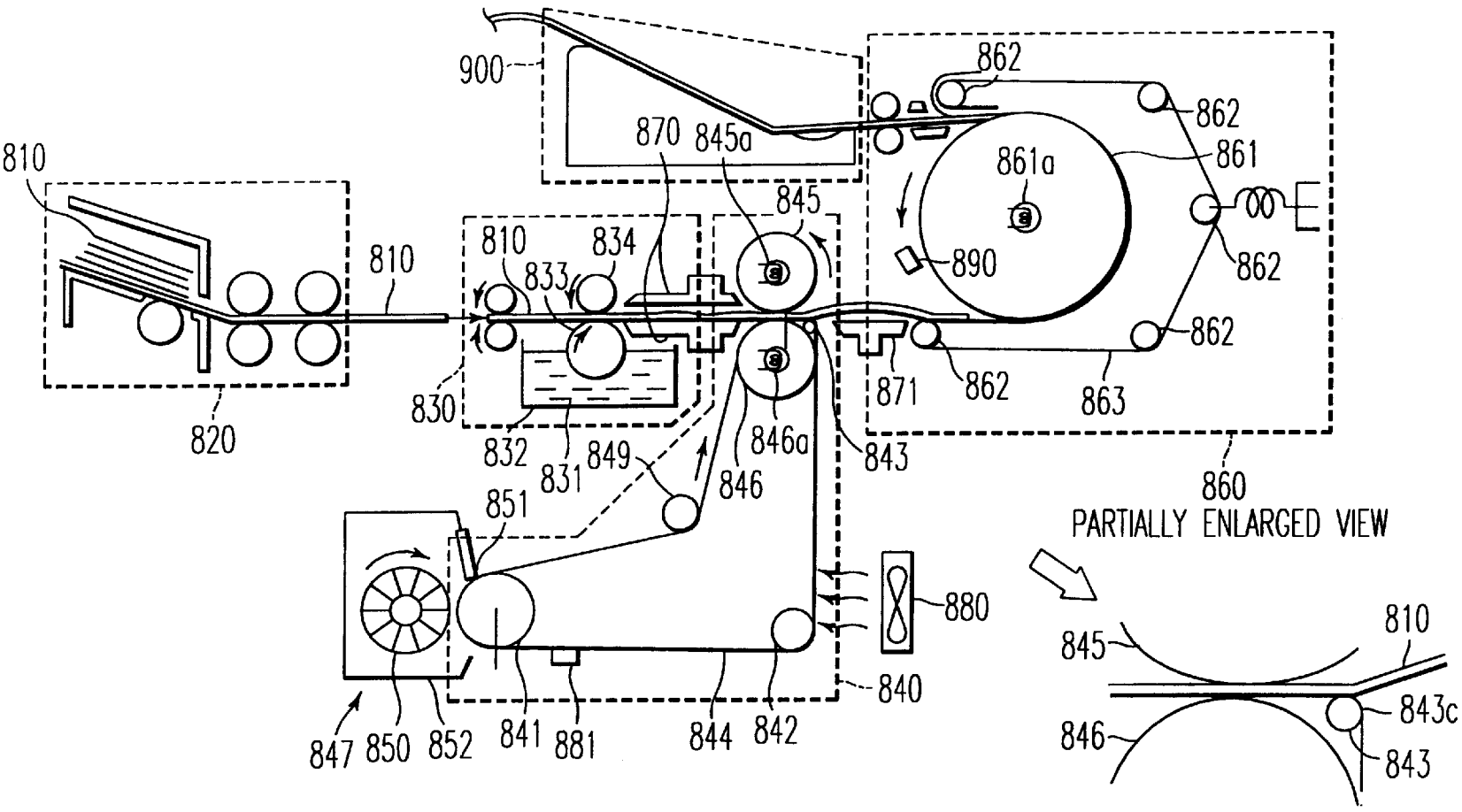
FIG. 2*a* is a construction view showing an overall configuration of the toner removing apparatus of an embodiment according to the present invention.

Moreover, in the toner peeling-off unit 840 shown in FIG. 2*a,* there is provided a guide plate 870 for guiding the transferring paper 810 transported front the side of the liquid supplying unit 830 to the pressurized portion between the peeling-off belt 844 portion which moves by the action of the backup by the roller 843. Furthermore, in the same unit 840, there is further provided a lower guide plate 871 for guiding, to the drying unit 860 side, the transferring paper 810 separated with curvature from the offset (peeling-off) belt 844 around the downstream-side corner portion 843*c* of the roller 843. The corner portion 843*c* thereof is shown in the partially enlarged portion of the right-lower side in FIG. 2*a*.

Figure 2B:
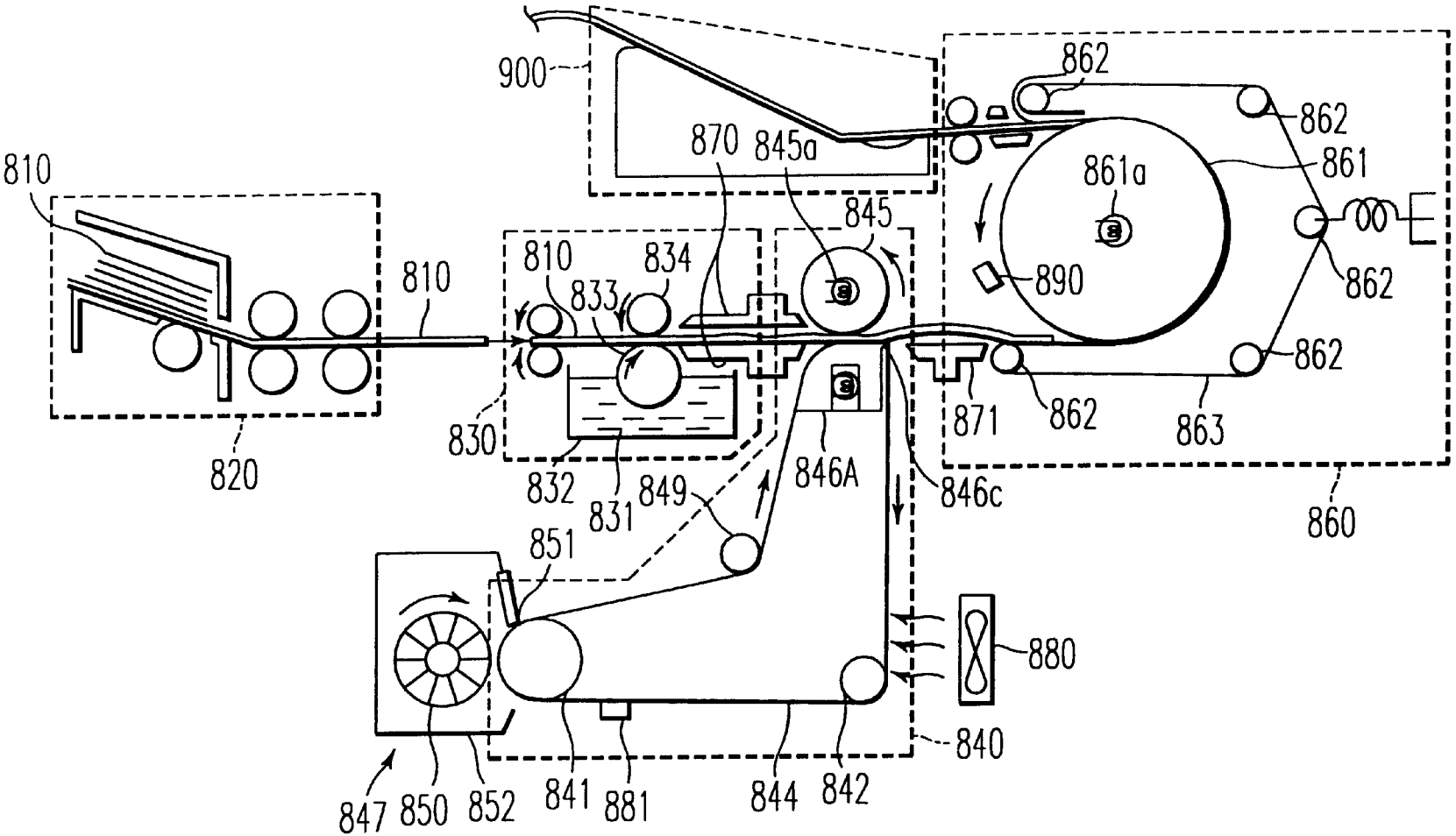
FIG. 2*b* is a construction view showing an overall configuration of the toner removing apparatus of another embodiment according to the present invention.

Furthermore, regarding the above-mentioned corner portion 843*c* shown in FIG. 2*a*, it is also possible to employ a heating block 846A as shown in FIG. 2*b* instead of the lower heating roller 846 having the heating lamp 846*a* therein and the roller 843. The above heating block 846A has the downstream-side corner portion 846*c* on the right shoulder portion thereof and the corner portion 846*c* performs the same function as that of the portion 843*c*.

And further, in the toner peeling-off unit 840 according to the present embodiment, there is provided a cooling fan 880, etc. for cooling the toner on the peeling-off belt 844.

The afore-mentioned drying unit 860 is the one for drying the paper 810 such that, for instance, the liquid holding amount of the paper 810 becomes 10% or less of the paper weight. The same unit 860 comprises a heating drum 861 made of metal such as aluminum, etc. accommodating a heating lamp 861*a* therein, and a paper pressing belt 863 moving endlessly in a state of being suspended on a plurality of supporting rollers 862, and put on the heating drum 861 in a state of winding itself by a constant angle around the circumferential surface of the heating drum 861.

As to the embodiment shown in FIG. 2, one supporting roller 862 is commonly used also as the tension roller.

And further, as the material for the afore-mentioned paper pressing belt 863, it is possible to use heatproof or ventilatable substance, that is, cloth such as canvas cloth, cotton cloth, tetron cloth, etc. It is desirable to employ a substance that expands as little as possible. Furthermore, the paper 810 is clippingly held with a certain extent of force between the circumferential surface of the heating drum and the inner surface of the belt, such that the paper 810 contracts in a completely free state and does not cause any wrinkles during the time period of putting forward the drying operation in the winding area onto the circumferential surface of the heating drum, and such that the paper 810 is prevented from being curled or wavy.

Hereupon, as shown in FIG. 2, regarding the afore-mentioned heating lamp 861*a*, it is desirable that temperature of the heating drum 861 is controlled so as to keep the temperature not less than the boiling point of the liquid contained in the transferring paper 810 (for instance, in the case of employing the water containing the surface active agent as an unstable agent liquid, the boiling point is almost 100° C.), on the basis of the output generated from the temperature sensor 890 disposed so as to oppose to the surface of the heating drum 861.

Figure 3:
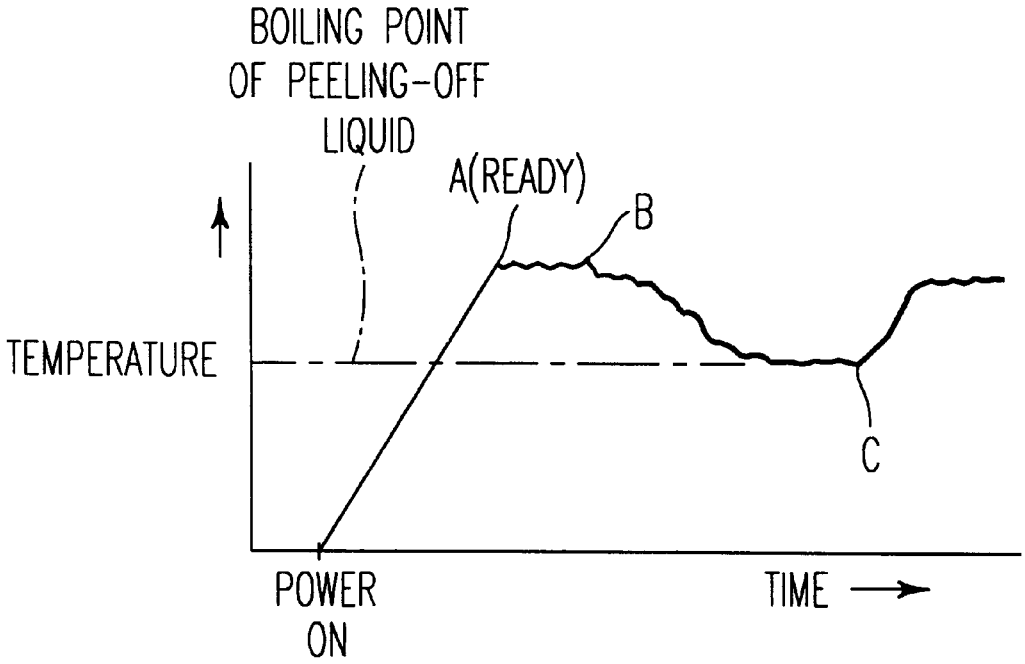
FIG. 3 is a graph relating to the temperature control of a dryer unit in the toner removing apparatus according to the present invention.

For this reason, for instance as shown in FIG. 3, it is desirable that a ready signal of allowing to start the toner removing process is issued at the time point a when the surface temperature of the heating drum 861 reaches the temperature sufficiently higher than the above-mentioned boiling point, in consideration of the shift of response between the heat emission from the heating lamp 861*a* and the surface temperature increase of the heating drum 861 or the surface temperature decrease of the same 861 during the time period of drying due to the evaporation heat, and it is desirable to utilize the temperature a little higher than the above boiling point as the target temperature for performing the control action thereafter. (For instance, in case that the boiling point is 100° C, the target temperature is approx. 120° C.) In such situation, as shown in FIG. 3, even though the temperature of the heating drum 861 decreases during the time period from the time point b when the leading tip end of the transferring paper 810 advances to the clippingly-holding portion between the heating drum 861 and the paper pressing belt 863 to the other time point c when the trailing tip end of the paper 810 passes through the same clippingly-holding portion, the temperature of the heating drum 861 can be kept above the boiling point.

The above-mentioned paper receiving unit can be constructed with a pair of upper and lower guide members for guiding the transferring paper 810 slipping out of the clippingly-holding area between the heating drum and the paper pressing belt, a pair of paper discharging rollers for transporting and discharging the transferring paper 810 guided by the guide members, and a tray for receiving the transferring paper discharged by the paper discharging rollers.

In the above-mentioned construction, the paper 810 transported from the paper feeding unit 820 is uniformly provided with liquid on the toner image surface thereof by the liquid supplying unit 830, and the paper 810 is sent to the toner removing unit 840. In the toner removing unit 840, the toner firmly sticking on the paper is softened by heating from the heating rollers 845 and 846 and sticks to the surface of the peeling-off belt 844. And then, when the toner is separated from the paper and the peeling-off belt 844 around the small-diameter roller 843, the toner sticking on the surface of the peeling-off belt 844, and thereby the toner is removed from the paper. The paper removed the toner therefrom is dried at the drying unit 860 and discharged into the paper receiving unit 900.

As mentioned heretofore, according to the toner removing apparatus for removing the toner from the copied paper, since the liquid is supplied to the paper having the toner sticking thereon and the toner is peeled off in the state of infiltrating the liquid into the boundary surface portion between the paper and the toner, it is possible to remove the toner from the paper without damaging the paper fiber.

Next, the condition of preferably removing the toner from the peeling-off belt 844 by use of the afore-mentioned belt cleaning apparatus 847 is explained hereinafter.

At first, under the common conditions of the softening point 85° C. of the employed toner, the diameter 55 mm of the rotatable brush roller 850, the revolutions number 640 RPM of the roller 850, the pressing load weight 6 Kg of the roller 850, and the belt running distance approx. 150 mm from the pressing contact portion of the upper and lower heating rollers 845 and 846 to the cleaning portion, the line velocity of the peeling-off belt 844 is changed in various ways. And further, regarding the temperature settings of the upper and lower heating rollers 845 and 846, in case that the temperature of the toner is changed such that the toner can be softened to an extent that the preferable peeling-off can be done in accordance with the line velocity of the peeling-off belt 844, the result of examining the removing rate (square-measure rate of the removed portion) by the action of the rotatable brush roller 850 and the surface temperature of the peeling-off belt 844 immediately before the cleaning portion by the action of the belt cleaning apparatus 847 is explained hereinafter. Hereupon, as shown in FIG. 2, the temperature sensor 881 is disposed such that the sensor 881 opposes to the belt at the upstream side of the cleaning portion in the belt cleaning apparatus 847 in the peeling-off belt moving direction, and the detection of the peeling-off belt's surface temperature is (done in such construction as mentioned above.

Figure 2C:
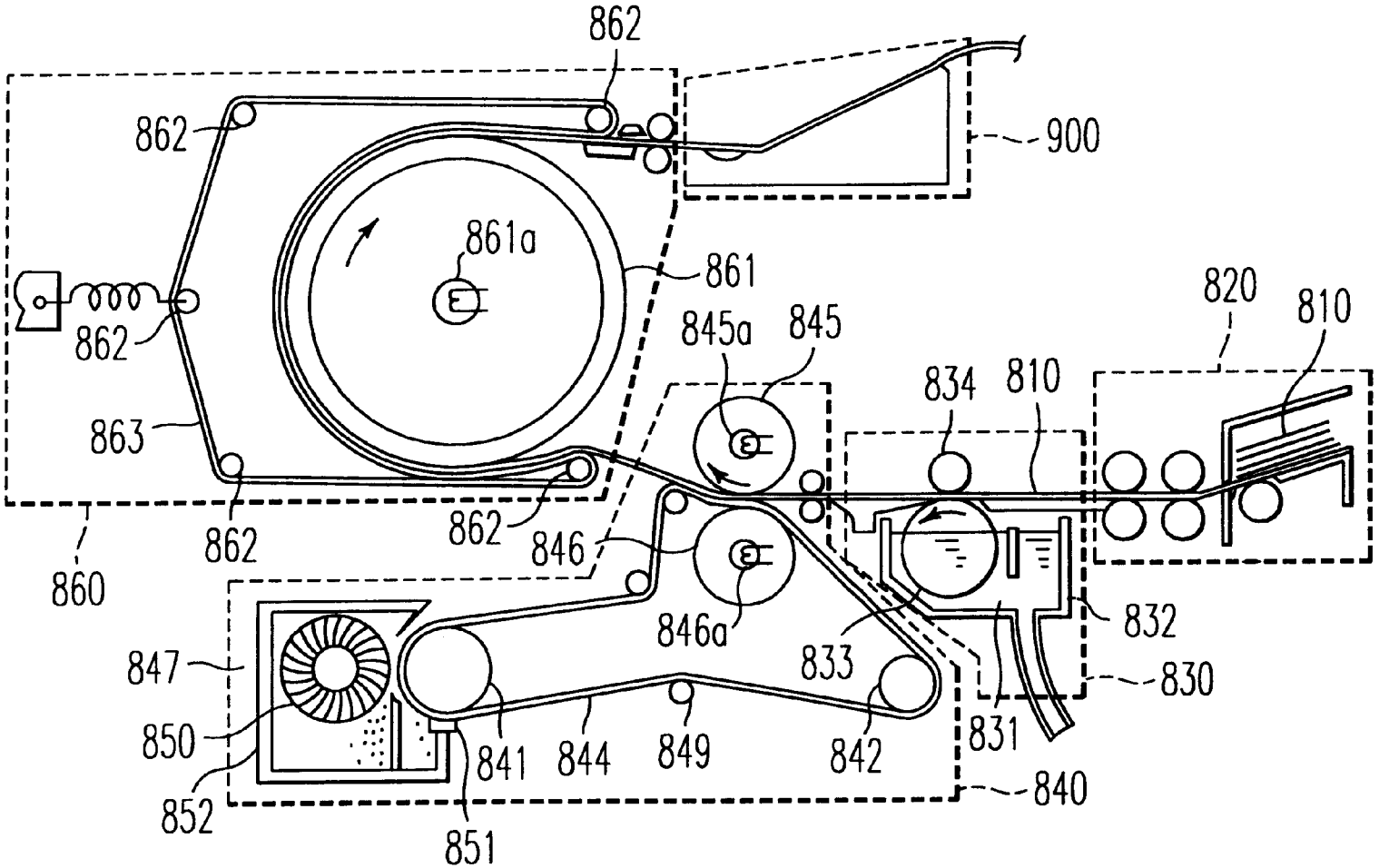
FIG. 2*c* is a construction view showing an overall configuration of the toner removing apparatus of a still another embodiment (modification) according to the present invention.

Heretofore, two embodiments of the toner removing apparatus according to the present invention are shown in FIGS. 2*a* and 2*b*. Furthermore, a modification thereof is shown in FIG. 2*c*. Although the structure and arrangement of the respective portions in the toner removing apparatus as shown in FIG. 2*c* differ a little from those of the above two embodiments, the principle operational function is same as that of the embodiments.

Concrete Example 1

In case that the line velocity of the peeling-off belt 844 is 15 mm/sec. and the temperature of the upper heating roller 845 is in the range of 90° C.–105° C. while that of the lower heating roller 846 is in the range of 80° C.–90° C., it follows that the removal rate of removing toner by use Of the rotatable brush roller 850 is 100% and the surface temperature of the peeling-off belt 844 is 36° C.

Comparative Example 1

On the other hand, in case that the toner removing process speed is increased, the line velocity of the peeling-off belt 844 is 30 mm/sec., and the temperature of the upper heating roller 845 is in the range of 120° C.–150° C. while that of the lower heating roller 846 is in the range of 100° C.–130° C., it follows that the removal rate of removing toner by use of the rotatable brush roller 850 is in the range of 0– 5% and the surface temperature of the peeling-off belt 844 is in the range of 75° C.–95° C. Hereupon, the temperatures of the above-mentioned upper and lower heating rollers 845 and 846 are the necessary ones for obtaining 100%-peeling-off at the above line velocity.

Comparative Example 2

Furthermore, when the pressing load of the rotatable brush roller is increased to 20 Kg weight compared with the above comparative example 1, expecting an improvement of the above removal rate although the removal rate by use of the rotatable brush roller 850 can be improved to 30–50%, the toner remains in a trailing state. And further, in this examples the toner portion sticking on the surface of the peeling-off belt 844 in a state of forming a large-black area (region), in particular, a large-black area toner portion of not smaller than 5 nun square is removed. Under such condition, it has been made apparent that there exists a difference in the extent of removing the toner in accordance with the toner sticking pattern on the surface of the peeling-off belt 844.

Concrete Example 2

Furthermore, under the same condition as that of the above comparative example 2, the rotation of the peeling-off belt 844 is stopped after performing the toner removing process and the state is kept for 2–5 minutes. Thereafter, the rotation of the peeling-off belt 844 is started again. When the peeling-off belt 844 portion naturally cooled in the air is cleaned, the removal rate of 95%–100% of removing the toner from the peeling-off belt 844 by use of the rotatable brush roller 850 can be obtained.

Furthermore, even the toner portion of 20 mm square stuck on the paper in a large-black area can be removed to a same extent as that of the 12-point Gothic type character. Furthermore, there is not recognized any difference of the removal extent due to the toner pattern sticking on the surface of the peeling-off belt 844. And further, there is not recognized any toner remaining in a trailing state. The temperature on the surface of the naturally-cooled portion is 50° C. Moreover, it is apparent from this example, if the distance from the pressurized contact portion of the upper and lower heating rollers 845 and 846 to the cleaning portion of the cleaning apparatus 847 is set long to an extent that the natural cooling can be done to a same extent, it seems that the same removal rate can be obtained without interrupting the rotation of the peeling-off belt 844.

From the experiment, etc. as mentioned heretofore, it could be made apparent that performing the cleaning action by use of the belt cleaning apparatus 847 at the time point when the temperature of the peeling-off belt 844, to state directly in other words, the temperature of the toner sticking on the surface of the belt 844 is lowered to the temperature sufficiently lower than the softening point of the toner, to state more concretely, the temperature in which the condensation force of the toner turns out to be larger than the sticking force between the toner and the peeling-off belt 844, is a condition of preferably removing the toner from the peeling-off belt 844. It seems that, in the condition that the temperature of the toner heated and softened at the pressed contact portion of the heating rollers 845 and 846 is lowered and thereby the toner is hardened to a certain extent, the toner can be preferably removed from the peeling-off belt 844 without dividing the toner into sections on the way in a state of sticking on both of the brush of the rotatable brush roller 850 and the surface of the peeling-off belt 844.

Consequently, for instance, as in the case of the aforementioned concrete example 1, and as mentioned in the embodiment in relation to the concrete example 2, in consideration of the line velocity of the peeling-off belt 844, it is permitted that the distance between the pressed contact portion of the upper and lower heating rollers 845 and 846 to the cleaning portion in the cleaning apparatus 847 is established to a distance such that the toner temperature is decreased to an extent that, at the time point when the peeling-off belt 844 with the toner arrives at the cleaning portion of the cleaning apparatus 847, the condensation force of the toner on the peeling-off belt 844 becomes larger than the sticking force between the toner and the peeling-off belt 844. Or, otherwise, when the toner is preferably removed from the peeling-off belt 844 by use of the belt cleaning apparatus 847, the rotation of the belt 844 is interrupted for a predetermined time period, and after the toner is naturally cooled the rotation of the peeling-off belt is started again and the cleaning operation is done, as mentioned in the concrete example 2.

Furthermore, in order to preferably perform the cleaning operation by use of the belt cleaning apparatus 847 without making large the distance from the pressed contact portion of the upper and lower heating rollers 845 and 846 and the cleaning portion in the cleaning apparatus 847, and without interrupting the rotation of the peeling-off belt 844, it is permitted to provide a cooling fan 880 as shown in FIG. 2 and forcibly cool the toner sticking on the peeling-off belt 844. In such construction, the peeling-off belt 844 can be favorably cleared without making the apparatus large-sized and without making the drive control of the peeling-off belt 844 complicated. Moreover, in the case of forcibly cooling the peeling-off belt 844 and the toner a larger shearing stress is exerted on the boundary surface between the surface of the peeling-off belt 844 and the toner due to the linear expansion coefficient difference between the peeling-off belt 844 and the toner compared with the case of natural cooling, and thereby it seems that there arises an effect that the sticking force therebetween is lowered.

Concrete Example 3

For example, in the same condition as that of the above comparative example 2, when the above-mentioned cooling fan 880 operates with an air flow of 0.25 $mm^2$/min. and blows on the toner sticking side of the peeling-off belt 844, the removal rate same as that of the above-mentioned concrete example 2, that is, the removal rate of 95%–100% could be obtained as the removal rate by the rotatable brush roller 850. Furthermore, even the toner portion of 20 mm square stuck on the paper in a large-black area printing can be removed to a same extent as that of the 12-point Gothic type character. In such construction, there was recognized no difference of the toner removing extent in accordance with the toner sticking pattern on the surface of the peeling-off belt 844. And further, there was recognized no remaining toner in a state of trailing. The surface temperature in the concrete example 3 was 48° C.

Hereupon, in the case of forcibly cooling the toner on the peeling-off belt 844 by use of the cooling fan 880, etc., there arises a fear of insufficient toner softening on the transferring paper 810 by the upper and lower heating rollers 845 and 846, at the time point when the peeling-off belt 844 is cooled too much and advances into the pressed contact portion of the upper and lower heating rollers 845 and 846 after passing through the belt cleaning apparatus 847. According to the (Experiment, for instance, in the case of the same condition as that of the above-mentioned comparative example 2, when the peeling-off belt 844 is cooled to an extent that the above surface temperature turns out to be less than 50° C, the efficiency of peeling off the toner from the transferring paper 810 may become insufficient. Consequently, in the case of specially employing the cooling means such as the cooling fan 880, etc., it is necessary to prevent the peeling-off belt 844 from excessively cooling. For this reason, it is desirable to control the operation of the cooling fan 880, for instance, blowing time period, air flow quantity per unit time period by use of the detection signal of the above-mentioned temperature sensor 881.

According to the present embodiment mentioned heretofore, since the toner stuck on the peeling-off belt 844 can be preferably removed by means of the rotatable brush roller 850 of the belt cleaning apparatus 847 and the cleaning blade 851, an unfavorable separation between the transferring paper 810 and the peeling-off belt 844 due to the adhering operation of the toner remaining on the peeling-off belt 844 to the transferring paper 810 can be avoided.

Moreover, the above-mentioned embodiment is the one applying the present invention to the toner removing apparatus for removing the toner employed as the image forming substance from the ordinary transferring paper 810. However the present invention is not limited to the above, and the same is applicable to the removal apparatus for removing the image forming substance from the image supporting body consisting of the laminating body. Regarding the laminating body, for instance, the surface layer of the base sheet such as plastic layer is made of a material layer such as paper, etc. having water-absorbing characteristic and elasticity.

According to the first through fourth embodiments according to the present invention, at the time point when the temperature is lowered to an extent that the condensation (cohesion) force of the image forming substance on the peeling-off member for removing the image forming substance from the peeling-off member turns out to be larger than the sticking force between the image forming substance and the peeling-off member, the peeling-off member surface cleaning member is brought into contact with the surface of the peeling-off member, and in such construction the image forming substance (toner) is removed from the surface of the peeling-off member. Therefore, there occurs no troublesome matter that the image forming substance of the peeling-off member sticks to both of the surface of the peeling-off member and the cleaning member and the same is separated half way and partially remains on the surface of the peeling-off member. Consequently, the toner can be removed preferably. It follows that the image forming substance can be removed preferable, from the surface of the peeling-off member and thereby the state on the surface can be kept in a state of enabling to demonstrate a preferable efficiency of removing the image forming substance. Furthermore, jamming of the image supporting body in the apparatus due to the unfavorable separation of the peeling-off member and the image supporting body and peeling-off of the paper fiber in the case of employing paper, etc. as the image supporting body can be prevented.

In particular, according to the third embodiment according to the present invention, even though the distance between the separating position from the image supporting body and the contact portion of the peeling-off member surface cleaning member is comparatively short the temperature of the image forming substance on the peeling off member can be lowered to a desired value by providing the cooling apparatus. Consequently, the selection width (range) of the toner removing process speed can be widened and the speed-up of the apparatus performance can be realized without making the apparatus large-sized.

In particular, according to the fourth status of the embodiment according to the present invention, the performance of the above-mentioned cooling apparatus is controlled on the basis of the detected temperature of the peeling-off member, and the temperature of the image forming substance on the peeling-off member at the time point when the peeling-off member arrives at the contact portion contacting with the peeling-off member surface cleaning member can be surely lowered to a desired value regardless of the variation of the temperature in the apparatus. Consequently, the image forming substance can be preferably removed from the peeling-off member regardless of the variation of the temperature in the apparatus.

Figure 4A:
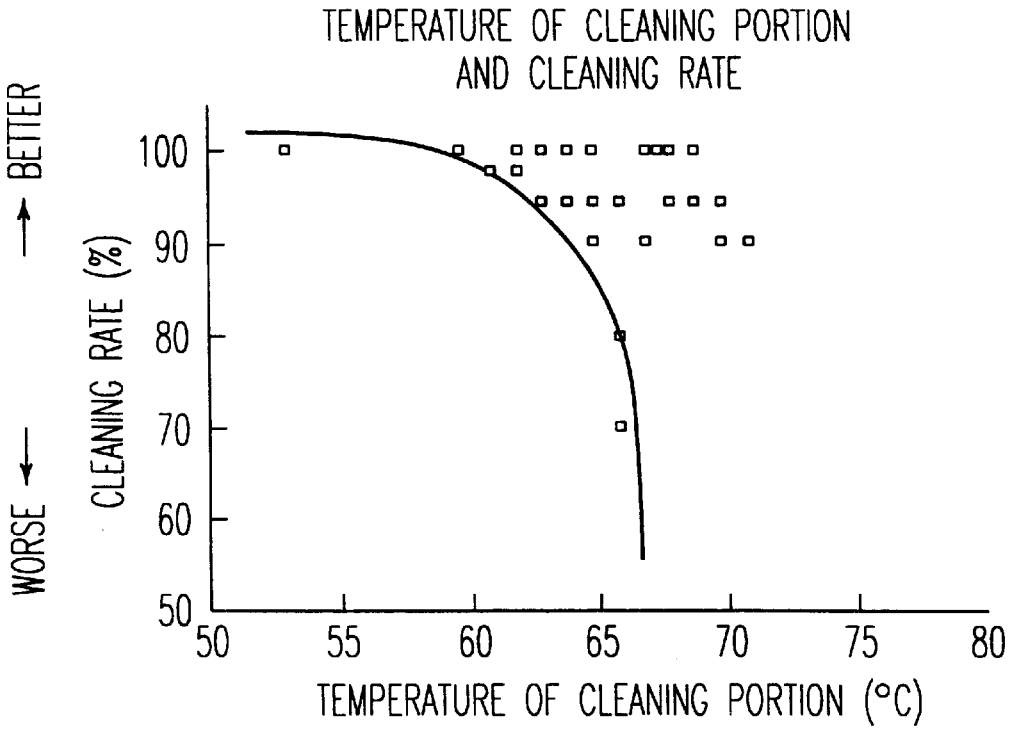
FIGS. 4*a* and 4*b* are, respectively, graphs showing the relationship between the temperature of the cleaning portion and the cleaning rate.
Figure 4B:
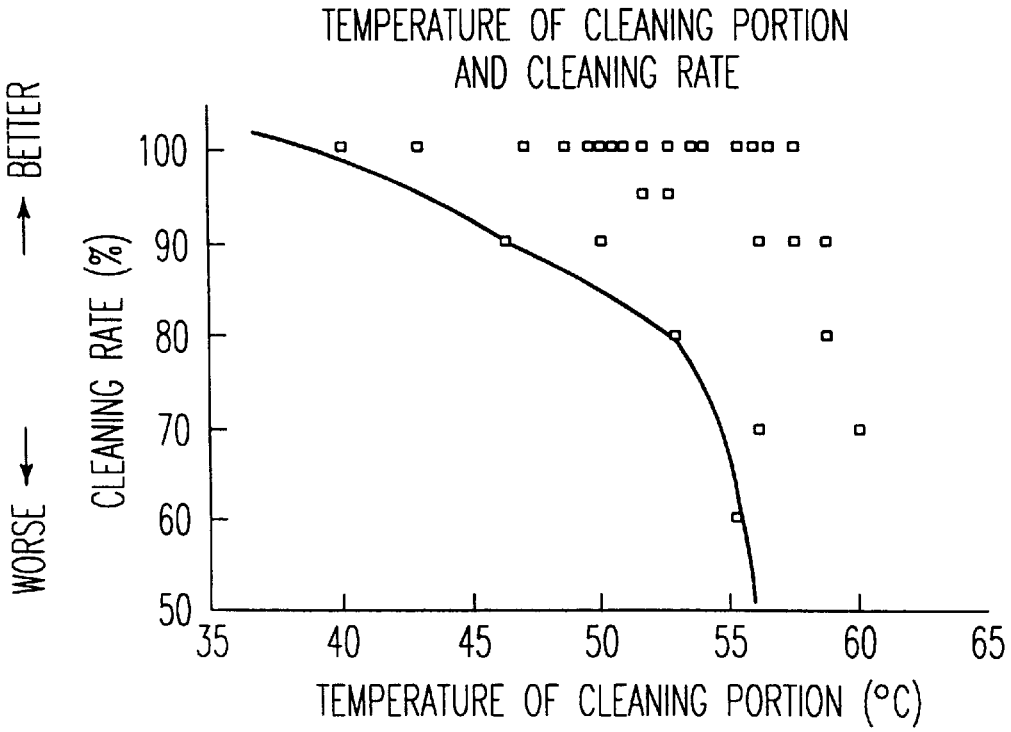

Hereinafter, various data regarding the cleaning rate for the peeling-off belt and the temperature of the belt cooled by use of the fan in the embodiment of the present invention are described, referring to FIGS. 4*a,* 4*b,* and 5. The temperature of the peeling-off substance in the cleaning portion is made high together with the improvement of the line velocity and the alteration of the construction. FIGS. 4*a* and 4*b* show the data of the relationship between the temperature of the cleaning portion and the cleaning rate in both cases of line velocities 30 mm/sec. and 20 mm/sec. in the experimental machine. From the experiment results, it is apparent that, when the temperature of the peeling-off substance becomes high, the cleaning rate turns out to be low.

In comparison of FIG. 4*a* with FIG. 4*b,* since the line velocity of the peeling-off belt is smaller in FIG. 4*b* than that in FIG. 4*a,* the belt is naturally cooled more effectively and thereby the temperature of the belt at the cleaning portion is lowered. The reason why the cleaning rate is lowered even in a state of lower temperature in FIG. 4*b* is that the time period for heatedly (pressurizedly) bonding the toner onto the offset (peeling-off) belt 301 at the upper heating roller 305 both shown in FIG. 1 is made longer (for instance, 1.5 times) in FIG. 4*b* compared with FIG. 4*a* and thereby the bonding strength of the toner to the peeling-off belt is largely increased.

From the viewpoint of enhancing the cleaning rate, it is more profitable to further increase (more than 30 mm/sec.) the line velocity of the peeling-off belt. However, it is absolutely necessary to set the line velocity of the belt within the value for enabling to sufficiently bond the toner onto the belt.

To state in summary, when the line velocity of the peeling-off belt is increased the cleaning rate is also increased (improved). However, the adhering (bonding) strength of the toner onto the belt is lowered. In consequence, there exists an optimum value of the belt's line velocity. If the line velocity of the belt is set to the optimum value, both functional effects of peeling off the toner from the transferring paper onto the peeling-off belt and cleaning the peeling-off belt can be obtained at the same time more advantageously on the optimum condition.

Figure 5:
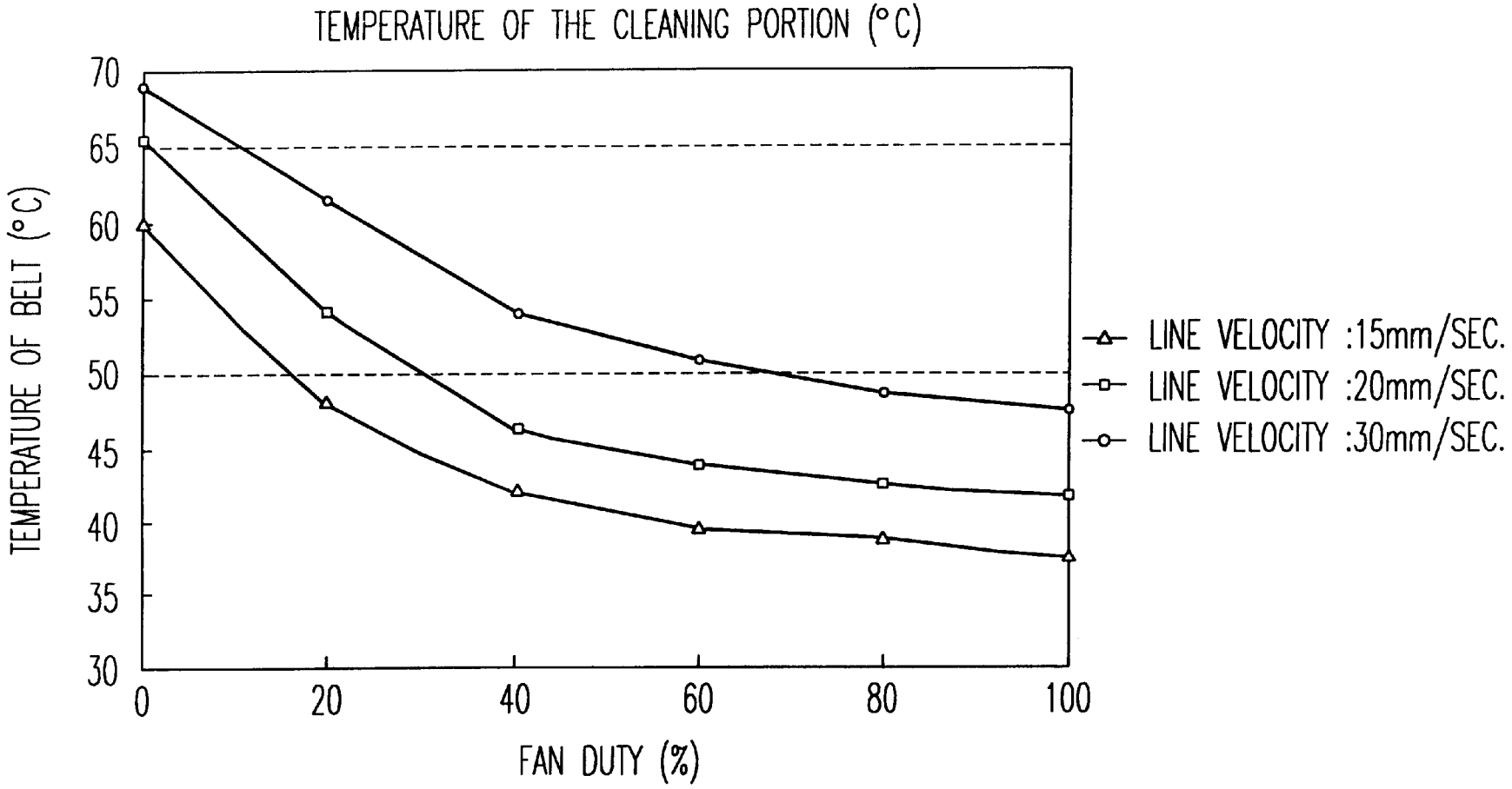
FIG. 5 is a graph showing the relationship between the fan duty and the temperature of the belt.

In such situation, a fan for cooling the peeling-off substance is provided in the experimental machine, and the cleaning operation is done in a state of lowering the temperature of the peeling-off substance in the cleaning portion. The advantageous effect of the c.Leaning fan is shown in FIG. 5. The fan duty (belt fan duty) in FIG. 5 signifies the rate of rotating the fan with PWM (Pulse Width Modulation). It is possible to think that the fan duty is almost equal to the quantity of the wind flow.

The fan employed in the experiment is MD410-24-Q3 made by oriental Motor Co., Ltd. (Specified Power Supply; DC12V, Specified Current; not more than 0.08A, Maximum Air Flow Quantity; 0.14 $m^3$/min.). In the experimental machine, three sets of fan are employed at intervals of 120 mm.

Figure 6A:
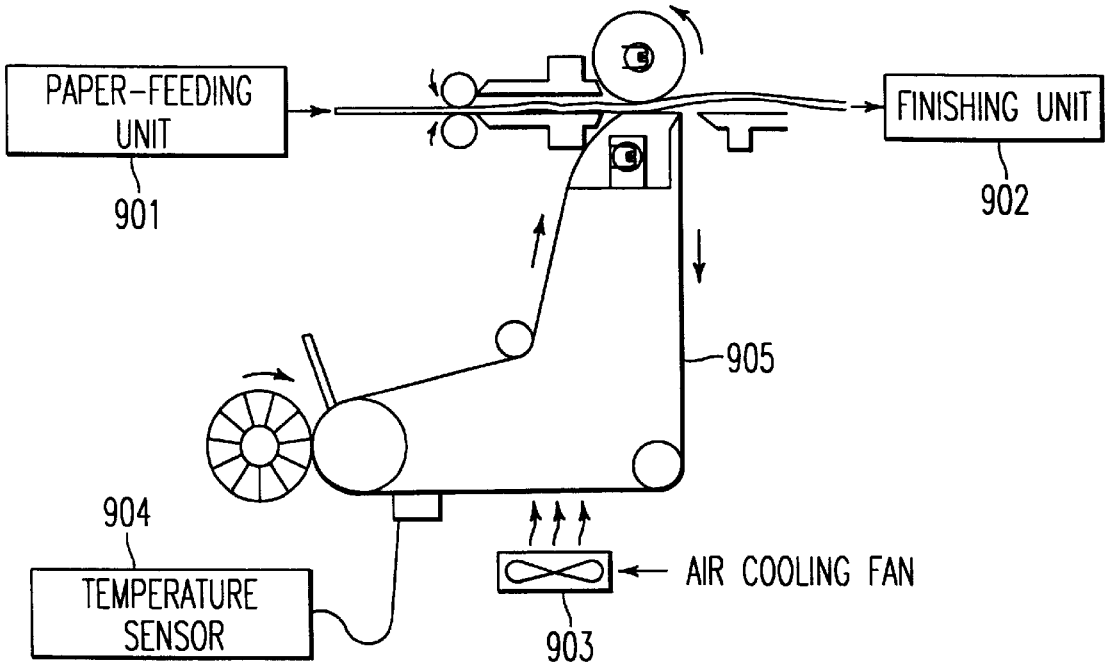
FIGS. 6*a* and 6*b* are construction views showing the locations of a peeling-off belt and an air-cooling fan.
Figure 6B:
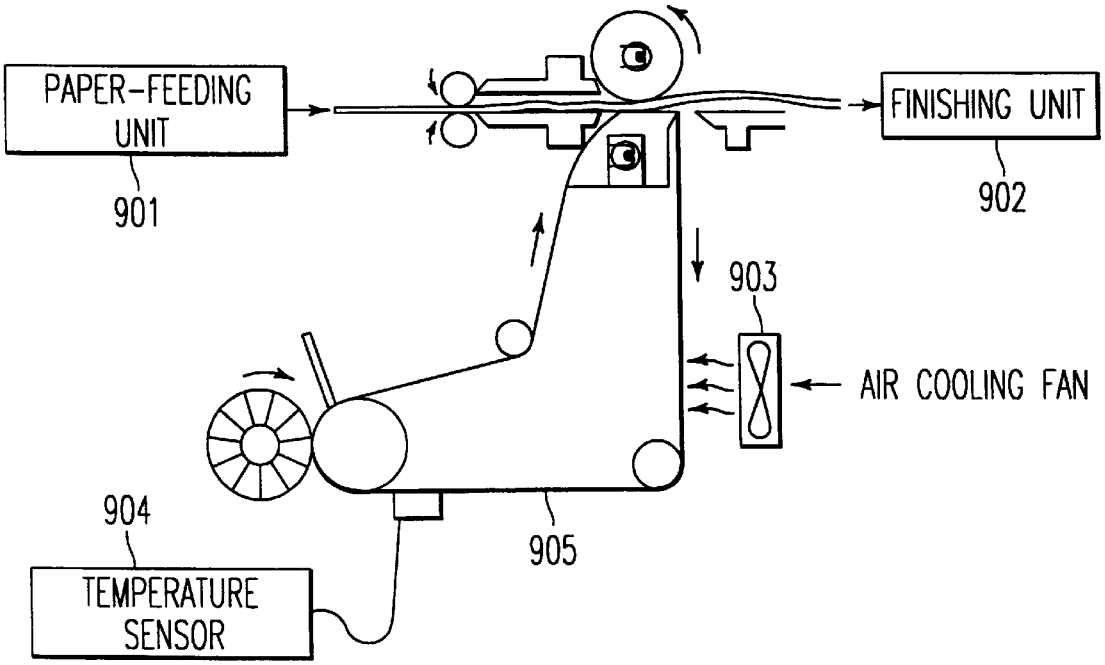

FIGS. 6*a* and 6*b* show the positional relationship between the fan and the temperature sensor.

In FIGS. 6*a* and 6*b,* the reference numeral 901 represents a paper-feeding unit, 902 a finishing unit, 903 an air-cooling fan for cooling the peeling-off belt 905, and 904 a temperature sensor. In FIG. 6*a,* the fan 903 is put near the vertical portion of the peeling-off belt 905. In FIG. 6*b,* the fan 903 is put near the horizontal portion of the peeling-off belt 905.

Instead of the air-cooling fan, a heat absorbing pipe, a heat exchanger, etc. can be used for cooling the peeling-off belt 905. For cooling the belt 905, speed-down of transporting the belt or long path for transporting the belt may be effective.

FIG. 7 is a table showing the relationship between the toner samples and the properties of toner. The toner samples 1 and 2 have a charge of positive polarity, while the toner samples 3 and 4 have a charge of negative polarity. The respective values of the average-volume particle diameter, the softening temperature, and the flow starting temperature are shown in the table of FIG. 7.

Heretofore, the main embodiment and modifications thereof according to the present invention has been described. The further supplementary structure and its exchanging of the offset belt 301 in the toner peeling-off unit 300 of the present invention is described hereinafter, referring to FIGS. 10 through 12.

Regarding the toner peeling-off unit 300 of the embodiment according to the present invention, the entire portion of the unit 300 excluding the upper heating roller 305 situated at the upper side from the transferring paper transporting path is constructed such that the portion can be attached to and detached from the main body of the toner removing apparatus.

Figure 10:
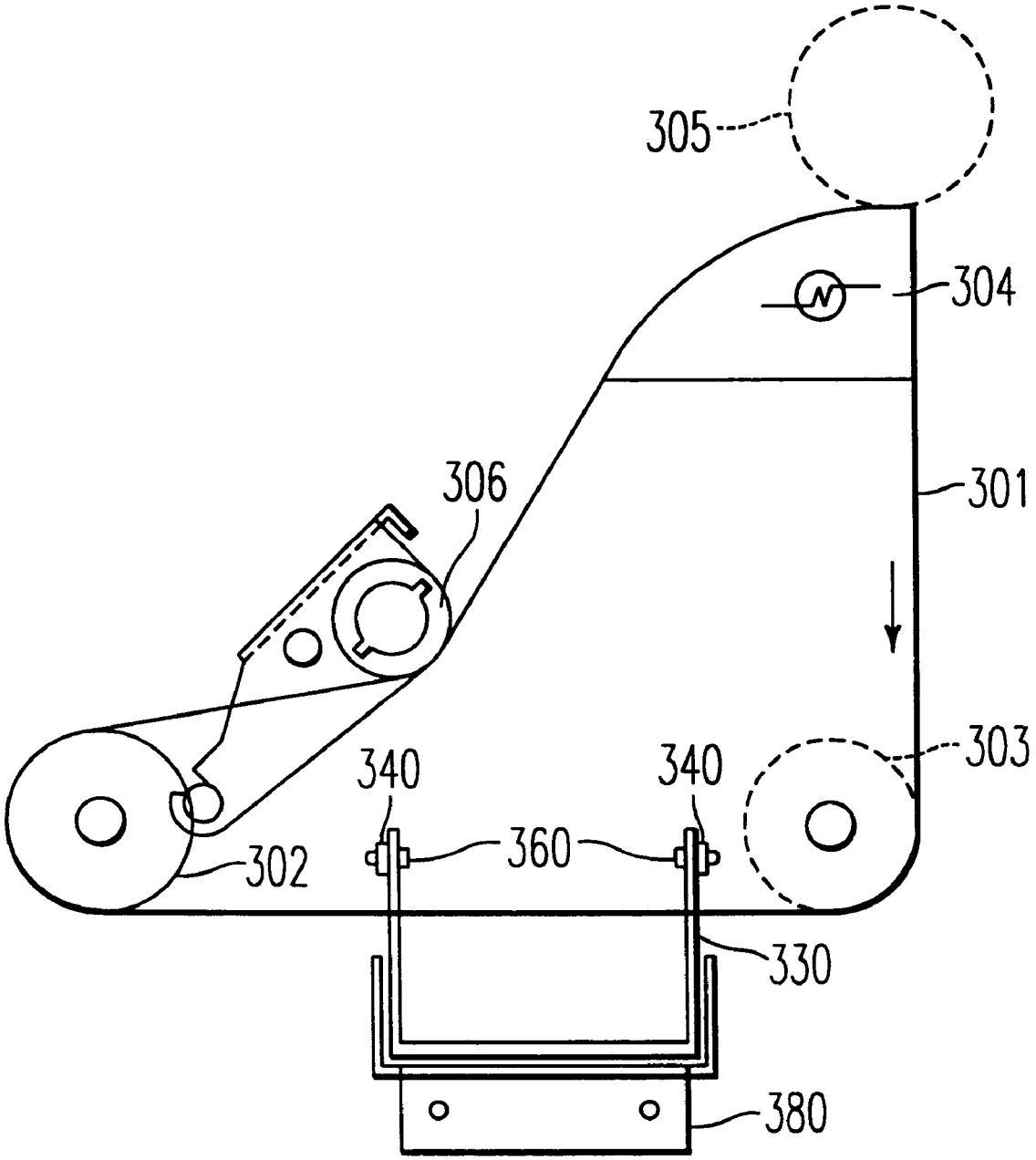
FIG. 10 is an enlarged view showing a toner peeling-off unit.

FIG. 10 is an enlarged view of the detachable portion of the toner peeling-off unit 300 of the present invention.

In order to exchange the offset belt 301 employed as the peeling-off member, the not-shown front cover of the apparatus main body shown in FIG. 1 is opened, the toner peeling-off unit 300 is drawn out to the front side along the guide 380 of the main body side and removed thereafter.

As shown in FIG. 10, the offset belt 301 of the toner peeling-off unit 300 is suspended around the plural supporting rollers 302 and 303, etc., and further, since both end portions of the plural supporting rollers 302 and 303 are respectively fixed by use of the both side plates 310 and 320, the locations between the respective supporting rollers are kept to the predetermined ones.

Figure 11:
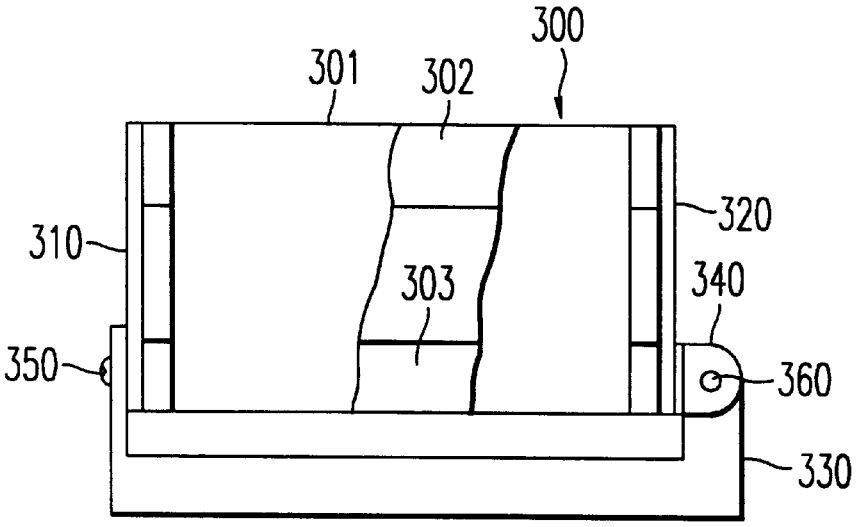
FIG. 11 is a left-side elevation view showing a toner peeling-off unit shown in FIG. 10.

FIG. 11 is a side elevational view of the toner peeling-off unit 300 removed from the main body of the apparatus. At the lower side of the toner peeling-off unit 300, there is provided a slide-type guide rail 330 having a U-shaped cross section as a guide member for unitarily taking out easily the toner peeling-off unit 300 from the main body of the apparatus. Both end portions of the guide rail 330 have a bent portion respectively so as to put therebetween both side plates 310 and 320 of the toner peeling-off unit 300. And further, the shape of the cross section thereof in the longitudinal direction of the guide rail 330 is made also U-shaped. Moreover, one side plate 310 of the toner peeling-off unit 300 is fixed by the fixing screw 350 through the hole at one end portion of the guide rail 330 such that the side plate 310 can be engaged with the screw hole not shown in FIG. 11 and formed on the side plate 310 and removed therefrom.

On the other hand, another side plate 320 of the toner peeling-off unit 300 and the other end portion of the guide rail 330 are rotatably connected to each other by use of the hinge 340 fixedly mounted on the side plate 320 and the connecting member 360.

Hereupon, as mentioned above, since the toner peeling-off unit 300 is heavy, it is difficult to exchange the offset belt 301 only in a state of drawing out the toner peeling-off unit 300 from the main body of the apparatus. Consequently, it follows that the toner peeling-off unit 300 has to be exchanged in a state of putting on the floor, etc.

However, when the offset belt 301 is exchanged, since the works of exchanging the offset belt is done by making that in a state of being put vertically the horizontally-set toner peeling-off unit 300 as described later, there arises a fear that the toner peeling-off unit 300 may become unstable due to the weight of the unit itself at the time of performing the exchanging works.

Figure 12:
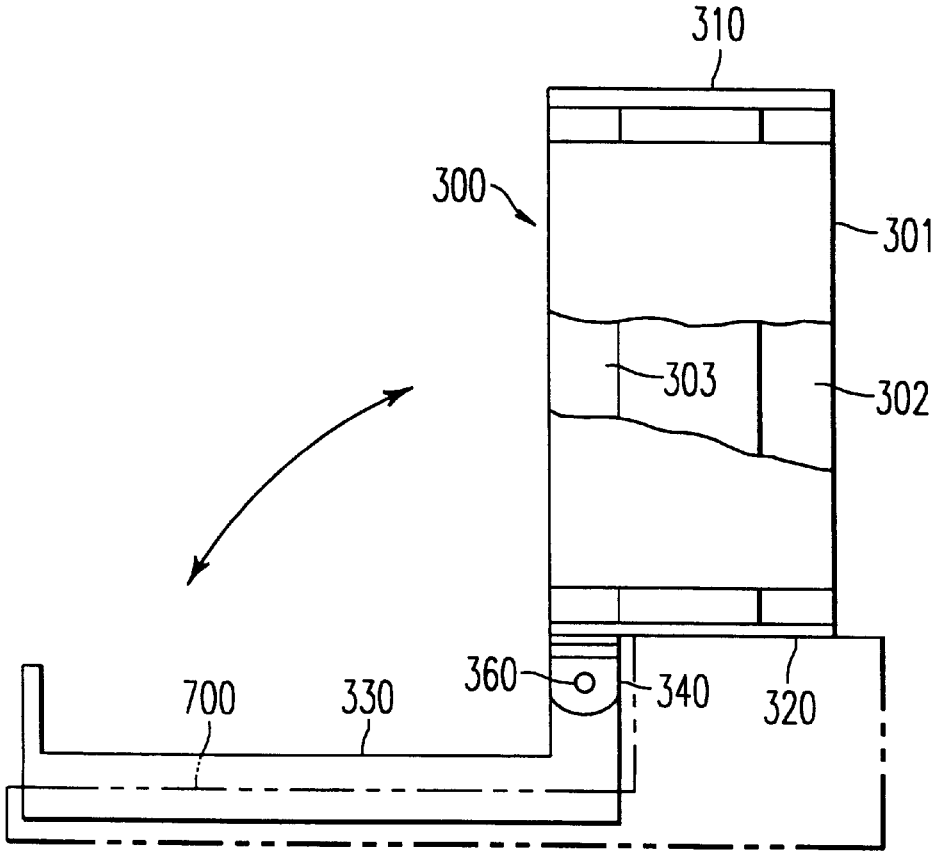
FIG. 12 is an elevation view illustrating the state of exchanging an offset belt.

Hereupon, in the present embodiment, in order to eliminate the unstability due to the weight of the unit itself at the time of the exchanging works, the toner peeling-off unit 300 is fixed on the jig comprising a guide capable of fixing the guide rail 330 and a pillow portion carrying the lower end portion of the toner peeling-off unit 300 which is set vertically and having a step difference equivalent to the height of the guide rail 300, as shown by two-dots-and-dash line in FIG. 12, and thereby the belt exchanging works can be done in a stable state. The jig 700 is fixed, at the lowermost position of the toner removing apparatus, on the drawer stand provided so as to draw out to the front side of the apparatus.

FIG. 12 shows a state at the time of exchanging the offset belt 301.

Regarding the toner peeling-off unit 300, a fixing screw 350 fixes the toner peeling-off unit 300 so as to be engaged with or removed from the main body through the hole of one end portion of the guide rail 330. When the fixing screw 350 is loosened and removed, one side of the toner peeling-off unit 300 turns out to be rotatable in the direction of the arrow shown in FIG. 12. Consequently, by lifting up the side plate 310 at the released side around the hinge 340, the offset belt 301 can be easily drawn out along the supporting roller and replaced by another offset belt 301.

In the present embodiment, as shown in FIG. 12, the toner peeling-off unit 300 is held such that the axis direction of the supporting rollers 302 and 303 becomes perpendicular to the floor surface. Thereby, since the load due to the weight of the unit itself applied to the supporting rollers 302 and 303 is reduced, the parallel accuracy between the supporting rollers which is required on the operating condition can be kept constant. In addition, the offset belt 301 can be exchanged easily. On such condition, the offset belt 301 is drawn out upward and removed from the supporting rollers 302 and 303. And then, another new offset belt is installed downward from the upside of the toner peeling-off unit 300. At this time, if there is an indication for the installing direction of the offset belt 301, the belt is installed in accordance with the indication.

Thereafter, in the reverse procedure to that mentioned above, the toner peeling-off unit 300 is put back to the initial condition.

According to the above embodiment, at the time of exchanging the offset belt 301, any load is not applied to the belt supporting mechanism. Furthermore, the operator does not have to take any unnatural posture, and the attaching and detaching operations can be done easily and surely. In particular, the working ease at the time of attaching/detaching can be considerably improved in comparison with the conventional apparatus.

Furthermore, since the surface of the offset belt 301 is scraped off by a strong force at the time of scratching (shoveling away) the attached toner by use of the above-mentioned cleaning brush 307 made of metal or the like, the belt 301 sharply deteriorates. Therefore, the life span (endurance) of the offset belt 301 becomes short.

Consequently, the frequency of exchanging is high, and in such situation, it is very effective for improving the working ease to adopt such construction.

In the afore-mentioned embodiment, the case of applying the belt apparatus according to the present invention to the toner peeling-off unit 300 employing the belt-shaped peeling-off member has been explained heretofore. However, it is not limited only to the toner peeling-off unit 300. Since the belt is employed for the transportation of the transferring paper 1 in the dryer unit 400 in the apparatus of the present embodiment, it is also possible to apply the belt to the dryer unit 400 in same way.

According to the belt apparatus of the present embodiment, the belt supporting mechanism is taken out from the main body of the belt apparatus, the engagement of the side plate portion removably engaged with the guide member among the side plate portions respectively supporting the both ends of the supporting roller in the supporting mechanism with the guide member is released, and the released side plate portion is mockingly moved around the connecting portion between the other side idlate portion rotatably connected to the guide member and the guide member. Thereby, it is possible to attach and detach the belt easily and surely along the supporting roller. Consequently, the working ease can be improved at the time of exchanging the belt, compared with the case of the conventional apparatus.

Moreover, for instance, if the exchanging work of the belt supported by the supporting roller and rotatably moving is performed in a state of making the axis line direction of the supporting roller in the belt supporting mechanism perpendicular to the surface on the floor, the exchanging work can be done without applying any load due to the weight of the belt supporting mechanism itself onto the belt supporting mechanism.

According to the image forming substance removing apparatus of the present embodiment for removing the image forming substance from the image supporting body, the peeling-off mechanism as the above-mentioned belt supporting mechanism is taken out from the image forming substance removing apparatus, the engagement of the side plate portion removably engaged with the guide member among the side plate portions respectively supporting the both ends of the supporting roller in the peeling-off mechanism with the guide member is released, and the released side plate portion is mockingly moved around the connecting portion between the other side plate portion rotatably connected to the guide member and the guide member. Thereby, it is possible to attach and detach the belt-shaped peeling-off member easily and surely along the supporting roller. Consequently, the working ease can be improved at the time of exchanging the belt, compared with the case of the conventional apparatus.

Moreover, for instance, if the exchanging work of the belt-shaped peeling-off member supported by the supporting roller and rotatably moved in a state of making the axis line direction of the supporting roller in the belt supporting mechanism perpendicular to the surface on the floor, the exchanging work can be done without applying any load due to the weight of the peeling-off member onto the supporting roller.

Furthermore, since the peeling-off member of the present image forming substance removing apparatus has to be exchanged frequently, the working ease can be prominently improved by applying the above-mentioned belt apparatus to the peeling-off mechanism, compared with the case of exchanging the peeling-off member in the conventional apparatus.

What is claimed as new and desired to be secured by Letters Patent of the United States is:

1. A method of recycling for removing an image forming substance held on an image holding member with a stable sticking force so that the image holding member may be reused, comprising steps of:

bringing said image holding member into contact with a transfer member so as to soften said image forming substance in a softening step and place said image forming substance in a softened state;

transferring said image forming substance from said image holding member to said transfer member while said image forming substance remains in the softened state;

lowering a temperature of said image forming substance to a lower temperature so said image forming substance becomes solidified; and removing said image forming substance when solidified from said transfer member.

2. The method of recycling as defined in claim 1, wherein:

said transferring step includes transferring the image forming substance to a belt, which serves as said transfer member.

3. The method of recycling as defined in claim 1, wherein:

the stable sticking force exerted between said image holding member and said image forming substance is lowered before said image holding member is brought into contact in said bringing step.

4. The method of recycling, as defined in claim 1, wherein:

the stable sticking force exerted between said image holding member and said image forming substance is changed to an unstabilized force before said image holding member is brought into contact with said transfer member in said bringing step.

5. The method of recycling, as defined in claim 1, further comprising a step of:

applying an agent to at least to an interfacial boundary between said image holding member and said image forming substance to lower a magnitude of said stable sticking force.

6. The method of recycling, as defined in claim 5, wherein:

said applying step includes applying a liquid as said agent; and subsequent to said removing step performing a step of evaporating said liquid remaining on said image holding member.

7. The method of recycling as defined in claim 1, wherein:

said lowering step includes lowering the temperature by blowing a gas from a fan against said image forming substance on said transfer member.

8. A recycling apparatus for removing an image forming substance formed on an image holding member with a stable sticking force so that the image holding member may be reused, comprising:

softening means for rendering said image forming substance formed on said image holding member in a softened state;

transfer means for transferring to said transfer means said image forming substance in the softened state from said image holding member; and means for lowering a temperature of said image forming substance while in said softened state on said transfer means to another predetermined temperature and cleaning means for cleaning said image forming substance from said transfer means when said image forming substance is at said predetermined temperature.

9. The recycling apparatus as defined in claim 8, wherein:

said softening means softens said image forming substance from a surface direction of said image forming substance that is brought into contact with said transfer means.

10. The recycling apparatus as defined in claim 8, wherein:

said transfer means includes a belt.

11. The recycling apparatus as defined in claim 10, wherein:

said softening means includes a heater that heats said image foaming substance from a rear surface of said image holding member that opposes said belt and toward said image forming substance.

12. The recycling apparatus as defined in claim 11, further comprising:

pressing means for pressing said image holding member to said belt at a predetermined pressing region while positioning said heater against said belt at said predetermined pressing region.

13. The recycling apparatus as defined in claim 8, wherein:

said cleaning means includes at least one of a rotatable brush and a blade.

14. The recycling apparatus as defined in claim 8, further comprising:

pressing means for pressing said image holding member to said transfer means.

15. The recycling apparatus as defined in claim 8, further comprising:

sticking force displacing means for lowering a magnitude of the stable sticking force exerted between said image holding member and said image forming substance before transferring said image forming substance from said image holding member to said transfer means.

16. The recycling apparatus as defined in claim 8, further comprising:

supplying means for supplying an agent for lowering a magnitude of the stable sticking force previously exerted between said image holding member and said image forming substance from said image holding member to said transfer means by use of said transfer means, said supplying means supplying said agent to at least to an interfacial surface between said image holding member and said image forming substance.

17. The recycling apparatus as defined in claim 16, wherein:

said agent being a liquid, said recycling apparatus further comprises, evaporating means for evaporating a residual amount of said liquid remaining on said image holding member after said image forming substance is separated from said image holding member by said transfer means.

18. The recycling apparatus as defined in claim 8, wherein:

the another predetermined temperature of said image forming substance being a temperature at which said image forming substance is solidified.

19. The recycling apparatus as defined in claim 8, further comprising:

temperature lowering means for lowering the temperature of said image forming substance prior to said cleaning means cleaning said image forming substance from said transfer means.

20. The recycling apparatus as defined in claim 19, wherein:

said temperature lowering medium includes a fan.

21. A recycling apparatus for removing an image forming substance formed on an image holding member with a stable sticking force so that the image holding member may be reused, comprising:

a heating member that heats said image forming substance and places said image forming substance in a softening state;

a transfer member that is rotatively driven by a drive member to bring a surface of said transfer member into contact with said image forming substance, said surface of said transfer member exhibiting a characteristic larger sticking force to said image forming substance when in said softened state than between said image holding member and said image forming substance; and a cleaning member configured to remove said image forming substance from said transfer member, wherein said transfer member being movable between a contact position where said image forming substance in the softening state contacts the transfer member, a separating position where a direction of movement of said transfer medium separates from said image holding member while said image forming substance remains in the softened state and a cleaning position which is located downstream of said separating position, where downstream is in reference to a moving direction of said transfer member;

said image forming substance in the softening state is transferred to said transfer member in an inclusive range between said contact position to said separating position;

said image forming substance changing from the softening state or said transfer member to a solidified state in another range between said separating position and said cleaning position, after being transferred to said transfer member, and said cleaning member being configured to remove said image forming substance from said transfer member after said image forming substance changes to said solidified state.

22. The recycling apparatus as defined in claim 21, wherein:

said heating member is positioned to oppose said transfer member on a side opposite to a side that receives said image forming substance; and said heating member being positioned near said contact position so as to impart heat to said image forming substance at said contact position.

23. The recycling apparatus as defined in claim 21, wherein:

said transfer member including a belt.

24. The recycling apparatus as defined in claim 21, further comprising:

a pressing member that is positioned to press said image holding member against said transfer member at said contact position.

25. The recycling apparatus as defined in claim 24, wherein:

said pressing member includes a heater.

26. The recycling apparatus as defined in claim 25, wherein:

said cleaning member includes a rotary brush that rotates in a same direction of rotation as said transfer member.

27. The recycling apparatus as defined in claim 21, wherein:

said cleaning member being a blade.

28. The recycling apparatus as defined in claim 21, further comprising:

a supplying member configured to apply an agent to an interfacial surface area between said image holding member and said image forming substance, said agent having a characteristic that lowers a magnitude of the stable sticking force exerted between said image holding member and said image forming substance.

29. The recycling apparatus as defined in claim 28, wherein:

said agent being a liquid; and said recycling apparatus further comprises a drying member configured to evaporate a residual portion of said liquid remaining on said image holding member after said image forming member is moved beyond said separating position.

30. An apparatus as recited in claim 21, further comprising:

a plurality of rollers over which said transfer member is suspended and a heater, said heater member being disposed in said heater.

31. A recycling apparatus for removing an image forming substance held on an image holding member with a stable sticking force so that the image holding member may be reused, comprising:

a heating member that heats said image forming substance and places said image forming substance in a softening state;

a transfer member that is rotatively driven by a drive member to bring a surface of said transfer member into contact with said image forming substance, said transfer member exhibiting a characteristic larger sticking force to said image forming substance than said image holding member;

a cooling member configured to cool said image forming substance when said image forming substance is transferred to said transfer member; and a cleaning member configured to remove said image forming substance from said transfer member, wherein said transfer member being movable between a contact position where said image forming substance in the softening state contacts the transfer member, a separating position where a direction of movement of said transfer medium separates from said image holding member while said image forming substance remains in the softened state, and a cleaning position which is located downstream of said separating position, where downstream is in reference to a moving direction of said transfer member, said image forming substance in the softening state being transferred to said transfer member in an inclusive range between said contact position to said separating position;

the cooling member being disposed in another range between said separating position and said cleaning position, after being transferred to said transfer member, and said cleaning member being configured to remove said image forming substance from said transfer member after said cooling member changes said image forming substance to said solidified state.

32. The recycling apparatus as defined in claim 31, wherein:

said heating member is positioned to oppose said transfer member on a side opposite to a side that receives said image forming substance; and said heating member being positioned near said contact position so as to impart heat to said image forming substance at said contact position.

33. The recycling apparatus as defined in claim 31, wherein:

said transfer member including a belt.

34. The recycling apparatus as defined in claim 31, wherein:

a pressing member that is positioned to press said image holding member against said transfer member at said contact position.

35. The recycling apparatus as defined in claim 34, wherein:

said pressing member includes a heater.

36. The recycling apparatus as defined in claim 31, wherein:

said cleaning member includes a rotary brush that rotates in a same direction of rotation as said transfer member.

37. The recycling apparatus as defined in claim 31, wherein:

said cleaning member being a blade.

38. The recycling apparatus as defined in claim 31, further comprising:

a supplying member configured to apply an agent to an interfacial surface area between said image holding member and said image forming substance, said agent having a characteristic that lowers a magnitude of the stable sticking force exerted between said image holding member and said image forming substance.

39. The recycling apparatus as defined in claim 38, wherein:

said agent being a liquid; and said recycling apparatus further comprises a drying member configured to evaporate a residual portion of said liquid remaining on said image holding member after said image forming member is moved beyond said separating position.

40. The recycling apparatus as defined in claim 31, wherein:

said cooling member including a fan.

41. An apparatus as recited in claim 30, wherein:

said transfer member comprises a belt suspended over a plurality of rollers, and a heater, said heating member being disposed in said heater.

42. The apparatus of claim 31, wherein:

said heating member comprises a heater.

43. An apparatus for removing a toner from a surface of a paper comprising:

a paper feeding unit that transports said paper to a contact area along a paper transporting direction, comprising a liquid applicator unit arranged to apply a liquid to said paper;

an offset belt arranged move along a predetermined path following a moving direction of said offset, said offset belt having a first surface comprising an adhesive layer that exerts a stronger sticking force to said image forming substance when in contact therewith than an opposing sticking force between a surface of said paper and said toner, said offset belt having a second surface;

a heater that produces heat, said heater being positioned against said second side of said belt so as to guide said belt to said contact area and bring said first surface of said belt in pressure contact with said toner on said paper at said contact area, wherein, heat from said heater being generally from a direction from said first side of said offset belt to said toner in said contact area;

means for creating a curved portion in said predetermined path, said curved portion curving away from said paper transporting direction so that toner adheres to said belt and separates from said paper while said toner remains in a softened state;

a pair of supporting rollers arranged to contact said second surface of said belt, said offset belt being suspended on said heater and said pair of supporting rollers, a first roller of said pair of rollers being arranged downstream of said moving direction of said contact area, and said second roller of said pair of rollers being arranged downstream of said first roller; and a cleaning brush disposed against said first surface of said offset belt so as to remove the toner therefrom after said toner has cooled to a lower temperature than when at said curved portion.

44. The apparatus of claim 43, further comprising:

a removable mechanical support assembly in which said offset belt, said heater and said pair of rollers are mounted so as to allow said offset belt, said heater and said pair of rollers to be removed from said apparatus when said offset belt is replaced in a maintenance operation.

45. The apparatus of claim 43, further comprising:

a belt drive mechanism configured to drive said offset belt at a predetermined speed so that said toner cools to a predetermined temperature before being removed from said offset belt by said cleaning brush.

46. An apparatus for removing a toner from a surface of a paper comprising:

a paper feeding unit that transports said paper to a contact area along a paper transporting direction, comprising, a liquid applicator unit configured to apply a liquid to said paper, and a heating roller that contacts another surface of the paper at a predetermined contact area;

a belt arranged move along a predetermined path following a moving direction, said belt having a first surface comprising an adhesive layer that exerts a stronger sticking force to said image forming substance when contacted therewith than an opposing sticking force between a surface of said paper and said toner, said offset belt having a second surface;

a heater that produces heat, said heater being positioned against said second side of said belt so as to guide said belt to said contact area and bring said first surface of said belt in pressure contact with said toner on said paper at said contact area, said heating roller and said heater sandwiching said paper and said belt therebetween at said contacting area, wherein, heat from said heater being generally from a direction from said first side of said offset belt to said toner in said contact area;

means for creating a curved portion in said predetermined path, said curved portion curving away from said paper transporting direction so that toner adheres to said belt and separates from said paper while said toner remains in a softened state;

a pair of supporting rollers arranged to contact said second surface of said belt, said offset belt being suspended on said heater and said pair of supporting rollers, a first roller of said pair of rollers being arranged downstream of said moving direction of said contact area, and said second roller of said pair of rollers being arranged downstream of said first roller, said first roller and said heater creating a tension on said belt therebetween so as to form a generally vertical portion in said predetermined path;

a cooling fan that produces an airflow in a predetermined direction, said cooling fan being positioned opposite to said generally vertical portion of said predetermined path so that said airflow is directed generally horizontally toward said toner on said first side of said belt so as to cool said toner;

a cleaning brush disposed against said first surface of said offset belt so as to remove the toner therefrom after said toner has cooled to a lower temperature than when at said curved portion.

47. The apparatus of claim 46, further comprising:

a removable mechanical support assembly on which said belt, said heater and said pair of rollers are mounted so as to allow said belt, said heater and said pair of rollers to be removed from said apparatus during a maintenance operation when replacing said belt.

48. The apparatus of claim 46, further comprising:

a belt drive mechanism configured to drive said belt along said predetermined path at a predetermined speed so that said toner cools to a predetermined temperature before being removed from said belt by said cleaning brush.

49. The apparatus of claim 46, further comprising:

a temperature sensor disposed along said predetermined path and upstream of said cleaning brush, said temperature sensor configured to actuate said fan whet a temperature of said image forming substance is above a predetermined temperature.

50. An apparatus for removing a toner from a surface of a paper comprising:

a paper feeding unit that transports said paper to a contact area along a paper transporting direction, comprising a liquid applicator unit arranged to apply a liquid to said paper;

a belt arranged move along a predetermined path following a moving direction, said belt having a first surface comprising an adhesive layer that exerts a stronger sticking force to said image forming substance when contacted therewith than an opposing sticking force between a surface of said paper and said toner, said belt having a second surface;

a heater that produces heat, said heater being positioned against said second side of said belt so as to guide said belt to said contact area and bring said first surface of said belt in pressure contact with said toner on said paper at said contact area, said heating roller and said heater sandwiching said paper and said belt therebetween at said contacting area, wherein, heat from said heater being generally directed to said toner in a direction from said first side of said belt to said toner in said contact area;

means for creating a curved portion in said predetermined path, said curved portion curving away from said paper transporting direction so that toner adheres to said belt and separates from said paper while said toner remains in a softened state;

a pair of supporting rollers arranged to contact said second surface of said belt, said offset belt being suspended on said heater and said pair of supporting rollers, a first roller of said pair of rollers being arranged downstream of said moving direction of said contact area, and said second roller of said pair of rollers being arranged downstream of said first roller, said first roller and said heater creating a tension on said belt so as to form a generally vertical portion in said predetermined path, said second roller and said first roller creating another tension on said belt so as to create a generally horizontal portion in said predetermined path;

a cooling fan that produces an airflow in a predetermined direction, said cooling fan being positioned opposite to said generally horizontal portion of said predetermined path so that said airflow is directed generally vertically toward said toner on said first side of said belt and causes said toner to cool; and a cleaning brush disposed against said first surface of said belt so as to remove the toner therefrom after said toner has cooled to a lower temperature than when at said curved portion.

51. The apparatus of claim 50, further comprising:

a removable mechanical support assembly on which said belt, said heater and said pair of rollers are mounted so as to allow said belt, said heater and said pair of rollers to be removed from said apparatus during a maintenance operation when replacing said belt.

52. The apparatus of claim 50, further comprising:

a belt drive mechanism configured to drive said belt along said predetermined path at a predetermined speed so that said toner cools to a predetermined temperature before being removed from said belt by said cleaning brush.

53. The apparatus of claim 50, further comprising:

a temperature sensor disposed along said predetermined path and upstream of said cleaning brush, said temperature sensor configured to actuate said fan when a temperature of said image forming substance is above a predetermined temperature.

* * * * *